US008456386B2

(12) United States Patent
Shin

(10) Patent No.: US 8,456,386 B2
(45) Date of Patent: Jun. 4, 2013

(54) DATA DRIVER INCLUDING SHIFT REGISTER UNIT, SAMPLING LATCH UNIT, HOLDING LATCH UNIT, AND DIGITAL-TO-ANALOG CONVERTER, AND ORGANIC LIGHT EMITTING DISPLAY USING THE SAME

(75) Inventor: Dong Yong Shin, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 713 days.

(21) Appl. No.: 11/655,223

(22) Filed: Jan. 19, 2007

(65) Prior Publication Data

US 2007/0236421 A1 Oct. 11, 2007

(30) Foreign Application Priority Data

Apr. 6, 2006 (KR) ..... 10-2006-0031637

(51) Int. Cl.
*G09G 3/30* (2006.01)

(52) U.S. Cl.
USPC ..... 345/76

(58) Field of Classification Search
USPC ..... 345/99, 100, 76–82; 377/64–81
See application file for complete search history.

(56) References Cited

U.S. PATENT DOCUMENTS

| | | | | |
|---|---|---|---|---|
| 6,331,884 | B1 | 12/2001 | Masazumi et al. | |
| 6,486,930 | B1 | 11/2002 | Kwon | |
| 6,989,844 | B2 | 1/2006 | Kageyama et al. | |
| 7,057,598 | B2 | 6/2006 | Azami et al. | |
| 2002/0084772 | A1 * | 7/2002 | Ruha et al. | 320/162 |
| 2003/0067434 | A1 * | 4/2003 | Haga et al. | 345/98 |
| 2004/0119666 | A1 | 6/2004 | Lim | |
| 2004/0150607 | A1 * | 8/2004 | Nakajima et al. | 345/100 |
| 2004/0155849 | A1 | 8/2004 | Bu et al. | |
| 2006/0176040 | A1 * | 8/2006 | Kernahan et al. | 323/299 |
| 2006/0214694 | A1 * | 9/2006 | Kida et al. | 326/93 |

FOREIGN PATENT DOCUMENTS

| | | |
|---|---|---|
| CN | 1 281 155 A | 1/2001 |
| EP | 1 300 826 | 4/2003 |
| EP | 1 300 826 A | 4/2003 |
| EP | 1 675 094 | 6/2006 |
| JP | 09-018011 | 1/1997 |

(Continued)

OTHER PUBLICATIONS

Matsueda, Y., et al., "35.1: 2.5-in. AMOLED with Integrated 6-Bit Gamma Compensated Digital Data Driver", 2004 SID International Symposium, Seattle, WA, pp. 1116-1119, (May 25-27, 2004).

(Continued)

*Primary Examiner* — Dennis Joseph
(74) *Attorney, Agent, or Firm* — Lee & Morse, P.C.

(57) ABSTRACT

A data driver including a shift register unit configured to receive a first clock signal, a second clock signal, and a start pulse, and to generate a sampling pulse, a sampling latch unit configured to receive and output bits and reversed bits of digital data, in correspondence with the sampling pulse, a holding latch unit configured to receive the bits and reversed bits output by the sampling latch unit, and to output the bits and reversed bits, in correspondence with a first enable signal and a second enable signal, and a digital-to-analog converter configured to receive the bits and reversed bits output by the holding latch unit and to generate an analog signal corresponding to values of the received bits and reversed bits.

21 Claims, 10 Drawing Sheets

FOREIGN PATENT DOCUMENTS

| | | | |
|---|---|---|---|
| JP | 2002-335153 | | 11/2002 |
| JP | 2004-085666 | | 3/2004 |
| JP | 2007-086727 | A | 4/2007 |
| KR | 2005 0111919 | | 11/2005 |
| TW | 1226506 | B | 1/2005 |
| TW | 2004-15561 | A | 11/2007 |

OTHER PUBLICATIONS

Taiwanese Office Action in TW 096102459, dated Sep. 27, 2011 (SHIN).

* cited by examiner

DATA DRIVER INCLUDING SHIFT REGISTER UNIT, SAMPLING LATCH UNIT, HOLDING LATCH UNIT, AND DIGITAL-TO-ANALOG CONVERTER, AND ORGANIC LIGHT EMITTING DISPLAY USING THE SAME

BACKGROUND OF THE INVENTION

1. Field of the Invention

The present invention relates to a data driver and an organic light emitting display using the same. More particularly, the present invention relates to a data driver which may be formed of PMOS transistors, and an organic light emitting display using the same.

2. Description of the Related Art

Various flat panel displays having reduced weight and volume as compared to cathode ray tubes (CRTs) have been developed. These flat panel displays include, e.g., a liquid crystal display (LCD), a field emission display (FED), a plasma display panel (PDP), an organic light emitting display, etc.

The organic light emitting display may display an image using an organic light emitting diode (OLED) that generates light by recombining an electron and a hole. The organic light emitting display may offer certain advantages, since it may exhibit low power consumption and may provide a rapid response time.

The organic light emitting display may include pixels arranged in a matrix, a data driver configured to drive data lines connected to the pixels, and a scan driver configured to drive scan lines connected to the pixels.

During operation, the data driver may supply data signals corresponding to data within every horizontal period, so as to display a predetermined image in the pixels. The scan driver may select pixels to which the data signals are supplied by sequentially supplying a scan signal within every horizontal period.

As a panel of the organic light emitting display increases in size, it may be desirable to mount the data driver in the panel, in order to reduce the size, weight and manufacturing expense associated with the display. It may be difficult, however, to mount a conventional data driver in the panel because the conventional data driver may include PMOS transistors and NMOS transistors. Therefore, it may be desirable to have a data driver that is implemented with only PMOS transistors, so that the data driver may be mountable in the panel.

SUMMARY OF THE INVENTION

The present invention is therefore directed to a data driver, and an organic light emitting display using the same, that substantially overcome one or more of the problems due to the limitations and disadvantages of the related art.

It is therefore a feature of an exemplary embodiment of the present invention to provide a data driver which may be formed of PMOS transistors and which may be mountable in a panel, and an organic light emitting display using the same.

At least one of the above and other features and advantages of the present invention may be realized by providing a data driver including a shift register unit configured to receive a first clock signal, a second clock signal, and a start pulse, and to generate a sampling pulse, a sampling latch unit configured to receive and output bits and reversed bits of digital data, in correspondence with the sampling pulse, a holding latch unit configured to receive the bits and reversed bits output by the sampling latch unit, and to output the bits and reversed bits, in correspondence with a first enable signal and a second enable signal, and a digital-to-analog converter configured to receive the bits and reversed bits output by the holding latch unit and to generate an analog signal corresponding to values of the received bits and reversed bits.

The shift register unit may include one shift register per channel. The sampling latch unit may include a predetermined number of sampling latches per channel, the predetermined number being twice a number of bits of input digital data. The holding latch unit may include the predetermined number of holding latches per channel.

The digital-to-analog converter may include a plurality of transistors configured to receive the bits and reversed bits output by the holding latch unit, and the transistors receiving the bits and reversed bits may be PMOS transistors.

A charging signal may be input at a high level to the sampling latch unit when the bits and reversed bits are input to the sampling latch unit. The first clock signal and the second clock signal may have a phase difference of about 180 degrees. The first clock signal and the second clock signal may both be at a high level during a predetermined period.

The shift register unit may include at least one shift register, the sampling latch unit may include at least one sampling latch, and the holding latch unit may include at least one holding latch, and the shift register, the sampling latch, and the holding latch may be substantially the same. The shift register, the sampling latch, and the holding latch may each include a first transistor having a gate electrode connected to a second input terminal, a second electrode connected to a first node, and a first electrode connected to an external input terminal, a second transistor having a gate electrode connected to the first node, a first electrode connected to a first input terminal, and a second electrode connected to an output terminal, a third transistor having a gate electrode connected to the second input terminal, a first electrode connected to a second node, and a second electrode connected to a fourth power supply, a fourth transistor having a gate electrode connected to the first node, a first electrode connected to the second input terminal, and a second electrode connected to the second node, a fifth transistor having a gate electrode connected to the second node, a first electrode connected to a third power supply, and a second electrode connected to the output terminal, and a capacitor connected between the gate electrode and the second electrode of the second transistor. The first through fifth transistors may be PMOS transistors.

The third power supply may provide a higher voltage than that provided by the fourth power supply. The shift register unit may include even and odd-numbered shift registers, the first clock signal may be supplied to the first input terminals of the odd-numbered shift registers, and the second clock signal may be supplied to the second input terminals of the odd-numbered shift registers. The second clock signal may be supplied to the first input terminals of the even-numbered shift registers, and the first clock signal may be supplied to the second input terminals of the even-numbered shift registers.

In the shift register, when a low level signal is supplied to the second input terminal, the capacitor may be charged with a voltage that corresponds to the voltage supplied from the external input terminal, and when a high level signal is supplied to the second input terminal, a voltage may be supplied to the output terminal that corresponds to the voltage charged in the capacitor. In the sampling latch, the sampling pulse may be supplied to the second input terminal, and a charging signal may be supplied to the first input terminal. The sampling latch may receive each bit or reversed bit when the sampling pulse is at a low level and the charging signal is at a high level, and the sampling latch may output each bit or reversed bit when the sampling pulse is at a high level and the charging signal is at a low level. In the holding latch, the first enable signal may be provided to the second input terminal, and the second enable signal may be provided to the first input terminal.

The first enable signal and the second enable signal may have a phase difference of about 180 degrees. The holding latch may receive a signal from the sampling latch when the first enable signal is at a low level, and the received signal may be output by the holding latch when the first enable signal is at a high level. The first enable signal may be maintained at a high level during output by the sampling latch, and the first enable signal may change to a low level after output by the sampling latch.

The data driver may further include a conversion unit configured to receive the first clock signal, the second clock signal and the sampling pulse, and to sequentially generate a conversion signal, wherein the conversion signal may be supplied to the sampling latch unit. The conversion unit may have one conversion circuit per channel. The conversion circuit may include an input unit and an output unit, the input unit may be configured to receive the sampling pulse at an input terminal thereof and to control a signal that is supplied to the output unit, and the output unit may be configured to control whether or not the conversion signal is output, in correspondence with the signal controlled by the input unit and the sampling pulse input to the input terminal.

The output unit may include an eleventh transistor having a first electrode connected to a third power supply and having a second electrode connected to an output terminal, a twelfth transistor having a first electrode connected to the output terminal and having a second electrode connected to a fourth power supply, the fourth power supply providing a lower voltage than that provided by the third power supply, a thirteenth transistor having a gate electrode connected to a gate electrode of the eleventh transistor and having a first electrode connected to the second electrode of the eleventh transistor, a fourteenth transistor having a first electrode connected to a second electrode of the thirteenth transistor, having a second electrode connected to the fourth power supply, and having a gate electrode connected to the input unit, a fifteenth transistor having a first electrode connected to a third input terminal, having a second electrode connected to the gate electrode of the eleventh transistor, and having a gate electrode connected to a first input terminal, a twelfth capacitor connected between the gate electrode and the first electrode of the eleventh transistor, and an eleventh capacitor connected between a gate electrode of the twelfth transistor and the first electrode of the twelfth transistor. The data driver may further include a fourteenth capacitor connected between the output terminal and the fourth power supply.

The input unit may include a sixteenth transistor having a first electrode connected to the gate electrode of the fourteenth transistor and having a second electrode connected to the first input terminal, a seventeenth transistor having a first electrode connected to a gate electrode of the sixteenth transistor, and having a gate electrode and a second electrode both connected to a second input terminal, an eighteenth transistor having a gate electrode connected to the third input terminal, having a first electrode connected to the third power supply, and having a second electrode connected to the gate electrode of the sixteenth transistor, and a thirteenth capacitor connected between the gate electrode of the sixteenth transistor and the first electrode of the sixteenth transistor. The eleventh through eighteenth transistors may be PMOS transistors. The conversion unit may include even numbered and odd-numbered conversion circuits, and the odd-numbered conversion circuits may receive the first clock signal at the first input terminal, and may receive the second clock signal at the second input terminal. The even-numbered conversion circuits may receive the second clock signal at the first input terminal, and may receive the first clock signal at the second input terminal. The conversion circuit may output a signal level opposite to a signal input to the third input terminal if a low level signal is input to the first input terminal, and the conversion circuit may maintain an output of a previous period if a high level signal is input to the first input terminal.

At least one of the above and other features and advantages of the present invention may also be realized by providing an organic light emitting display, including a scan driver configured to sequentially supply a scan signal to scan lines, a data driver configured to supply a data signal to data lines, and a pixel unit including a plurality of pixels connected to the scan lines and the data lines, wherein the data driver includes a shift register unit configured to receive a first clock signal, a second clock signal, and a start pulse, and to sequentially generate a sampling pulse, a sampling latch unit configured to receive and output bits and reversed bits of digital data, in correspondence with the sampling pulse, a holding latch unit configured to receive the bits and reversed bits output by the sampling latch unit, and to output the bits and reversed bits, in correspondence with a first enable signal and a second enable signal, and a digital-to-analog converter configured to receive the bits and reversed bits output by the holding latch unit and to generate an analog signal corresponding to values of the received bits and reversed bits.

The data driver may further include a conversion unit configured to receive the first clock signal, the second clock signal and the sampling pulse, and to sequentially generate a conversion signal, and the conversion signal may be supplied to the sampling latch unit.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
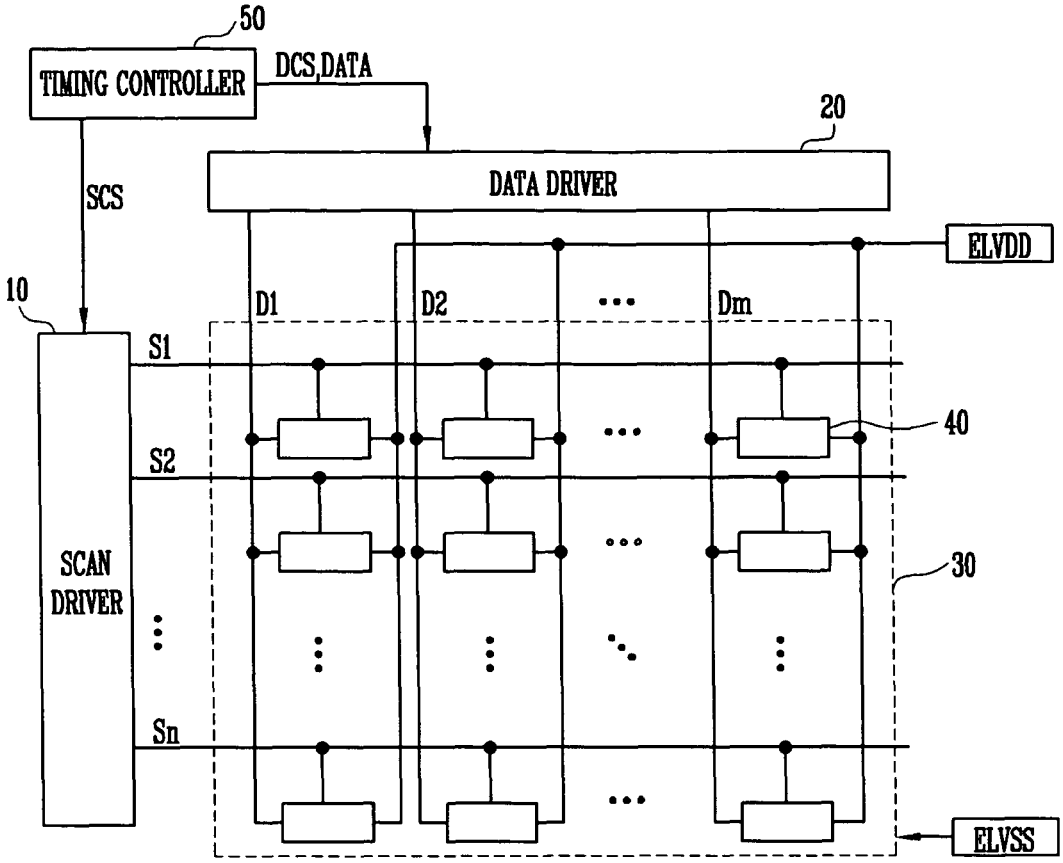
FIG. 1 illustrates a block diagram of an organic light emitting display according to an exemplary embodiment of the present invention.

Korean Patent Application No. 10-2006-0031637, filed on Apr. 6, 2006, in the Korean Intellectual Property Office, and entitled: "Data Driver and Organic Light Emitting Display Using the Same," is incorporated by reference herein in its entirety.

The present invention will now be described more fully hereinafter with reference to the accompanying drawings, in which exemplary embodiments of the invention are illustrated. The present invention may, however, be embodied in different forms and should not be construed as limited to the exemplary embodiments set forth herein. Rather, these exemplary embodiments are provided so that this disclosure will be thorough and complete, and will fully convey the scope of the invention to those skilled in the art. Like reference numerals refer to like elements throughout.

FIG. 1 illustrates a block diagram of an organic light emitting display according to an exemplary embodiment of the present invention. Referring to FIG. 1, the organic light emitting display may include a pixel unit 30 including a plurality of pixels 40 connected to scan lines (S1 . . . Sn) and data lines (D1 . . . Dm), a scan driver 10 configured to drive the scan lines (S1 . . . Sn), a data driver 20 configured to drive the data lines (D1 . . . Dm), and a timing controller 50 configured to control the scan driver 10 and the data driver 20.

The timing controller 50 may generate a data driver control signal (DCS) and a scan driver control signal (SCS) in correspondence to synchronization signals supplied from an external source. The data driver control signal (DCS) and the scan driver control signal (SCS) generated by the timing controller 50 may be supplied to the data driver 20 and the scan driver 10, respectively. The timing controller 50 may receive data from an external source and supply the (DATA) to the data driver 20.

The data driver 20 may receive the data driver control signal (DCS) from the timing controller 50. The data driver 20 may generate data signals and supply the generated data signals to the data lines (D1 to Dm), so as to synchronize with a scan signal.

The pixel unit 30 may receive a first power supply (ELVDD) and a second power supply (ELVSS) from an external source, and supply them to each of the pixels 40. Each of the pixels 40 receiving the first power supply (ELVDD) and the second power supply (ELVSS) may generate light corresponding to the data signal by controlling a current flowing from the first power supply (ELVDD) to the second power supply (ELVSS) via an electroluminescent device.

The scan driver 10 may receive the scan driver control signal (SCS) from the timing controller 50. The scan driver 10 may generate a scan signal and sequentially supply the generated scan signal to the scan lines (S1 to Sn).

Figure 2:
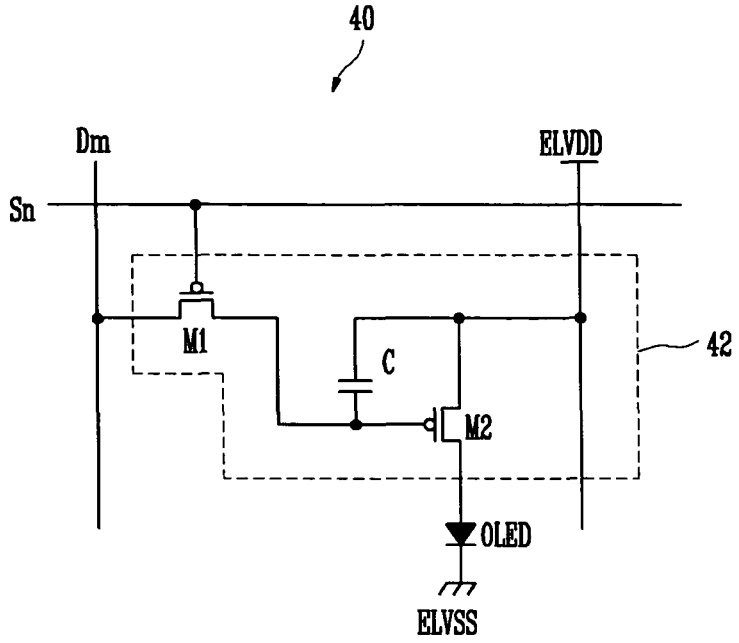
FIG. 2 illustrates a circuit diagram of an exemplary embodiment of a pixel of FIG. 1.

FIG. 2 illustrates a circuit diagram of an exemplary embodiment of a pixel of FIG. 1. For the sake of discussion, a pixel 40 connected to an $n^{th}$ scan line (Sn) and an $m^{th}$ data line (Dm) will be described, as illustrated in FIG. 2. Referring to FIG. 2, the pixel 40 may include an OLED and a pixel circuit 42 connected to the data line (Dm) and the scan line (Sn), so as to control whether or not the OLED may emit light.

An anode electrode of the OLED may be connected to the pixel circuit 42, and a cathode electrode of the OLED may be connected to the second power supply (ELVSS). The OLED may emit light in correspondence to a current supplied from the pixel circuit 42. That is, the pixel circuit 42 receiving the data signal supplied to the data line (Dm) may control whether or not the OLED emits light when the scan signal is supplied to the scan line (Sn).

The pixel circuit 42 may include a first transistor (M1) connected to a second transistor (M2), the data line (Dm), and the scan line (Sn). The pixel circuit 42 may also have the second transistor (M2) connected between the first power supply (ELVDD) and the OLED, and a storage capacitor (C) connected between a gate electrode and a first electrode of the second transistor (M2).

A gate electrode of the first transistor (M1) may be connected to the scan line (Sn), and a first electrode of the first transistor (M1) may be connected to the data line (Dm). A second electrode of the first transistor (M1) may be connected to one terminal of the storage capacitor (C). The first transistor (M1) may supply the data signal to the storage capacitor (C), since the first transistor (M1) may be turned on when the scan signal is supplied to the scan line (Sn). It is to be understood that the first electrode of the first transistor (M1) may be a source electrode or a drain electrode. For example, if the first electrode of the first transistor (M1) is the source electrode, the second electrode of the first transistor (M1) may be the drain electrode, and vice versa.

The gate electrode of the second transistor (M2) may be connected to one terminal of the storage capacitor (C), and the first electrode of the second transistor (M2) may be connected to the other terminal of the storage capacitor (C) and the first power supply (ELVDD). The second electrode of the second transistor (M2) may be connected to the OLED.

In this exemplary arrangement, the second transistor (M2) may control whether or not the OLED emits light according to the voltage stored in the storage capacitor (C). That is, the second transistor (M2) may allow the OLED to emit light when a predetermined voltage corresponding to the data signal is stored in the storage capacitor (C), and a current corresponding to the predetermined voltage may be supplied to the OLED.

Figure 3:
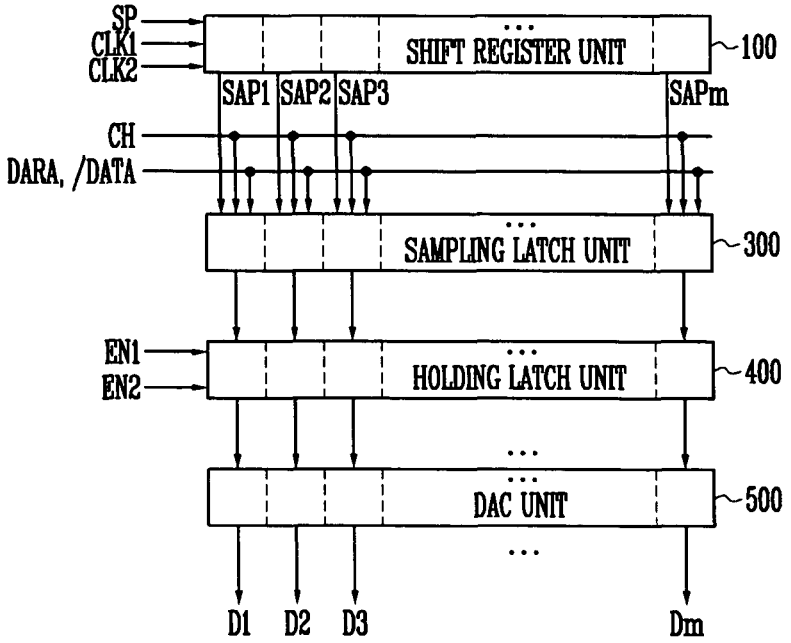
FIG. 3 illustrates a basic block diagram of a first exemplary embodiment of a data driver of FIG. 1.

FIG. 3 illustrates a basic block diagram of a first exemplary embodiment of a data driver of FIG. 1. The data driver 20 will be described assuming that it includes "m" channels. Referring to FIG. 3, the data driver 20 may include a shift register unit 100, a sampling latch unit 300, a holding latch unit 400, and a digital-analog converter (DAC) unit 500.

The shift register unit 100 may receive a start pulse (SP), a first clock signal (CLK1), and a second clock signal (CLK2), to sequentially generate a sampling pulse (SAP). The shift register unit 100 may include "m" shift registers.

The sampling latch unit 300 may receive the sampling pulse (SAP) and a charging signal (CH). The sampling latch unit 300 may also receive each bit and reversed bit of the input digital data, and may store the bit and the reversed bit of the input digital data. Accordingly, the sampling latch unit 300 may include twice as many sampling latches as the number of bits of the digital data input into every channel. For example, if a 6-bit digital data is input, then the sampling latch unit 300 may include 12 (=6×2) sampling latches in every channel. Each sampling latch may store the bit (DATA) or the reversed bit (/DATA) of the input digital data. As used herein, it will be understood that a reversed bit is an inverted bit, and the use of the forward slash symbol ("/") in connection with reference to a bit refers to a reversed bit, i.e., an inverted bit.

The holding latch unit 400 may receive a first enable signal (EN1) and a second enable signal (EN2). The holding latch unit 400 may simultaneously receive each bit and reversed bit output from the sampling latch unit 300. The holding latch unit 400 may output each bit and reversed bit to the DAC unit 500. Accordingly, similar to the sampling latch unit 300, the holding latch unit 400 also may have twice as many holding latches as the number of bits of the digital data input into every channel. For example, if a 6-bit digital data is input, then the holding latch unit 400 may include 12 (=6×2) holding latches in every channel.

The DAC unit 500 may generate an analog signal corresponding to each bit value of the digital data output from the holding latch unit 400. For example, the DAC unit 500 may select one of a plurality of gray scale voltages to correspond to the bit value of the digital data supplied from the holding latch unit 400 and generate an analog data signal. The DAC unit 500 may supply analog data signals to the data lines (D1 to Dm), respectively. The DAC unit 500 may include "m" number of DACs.

Figure 4:
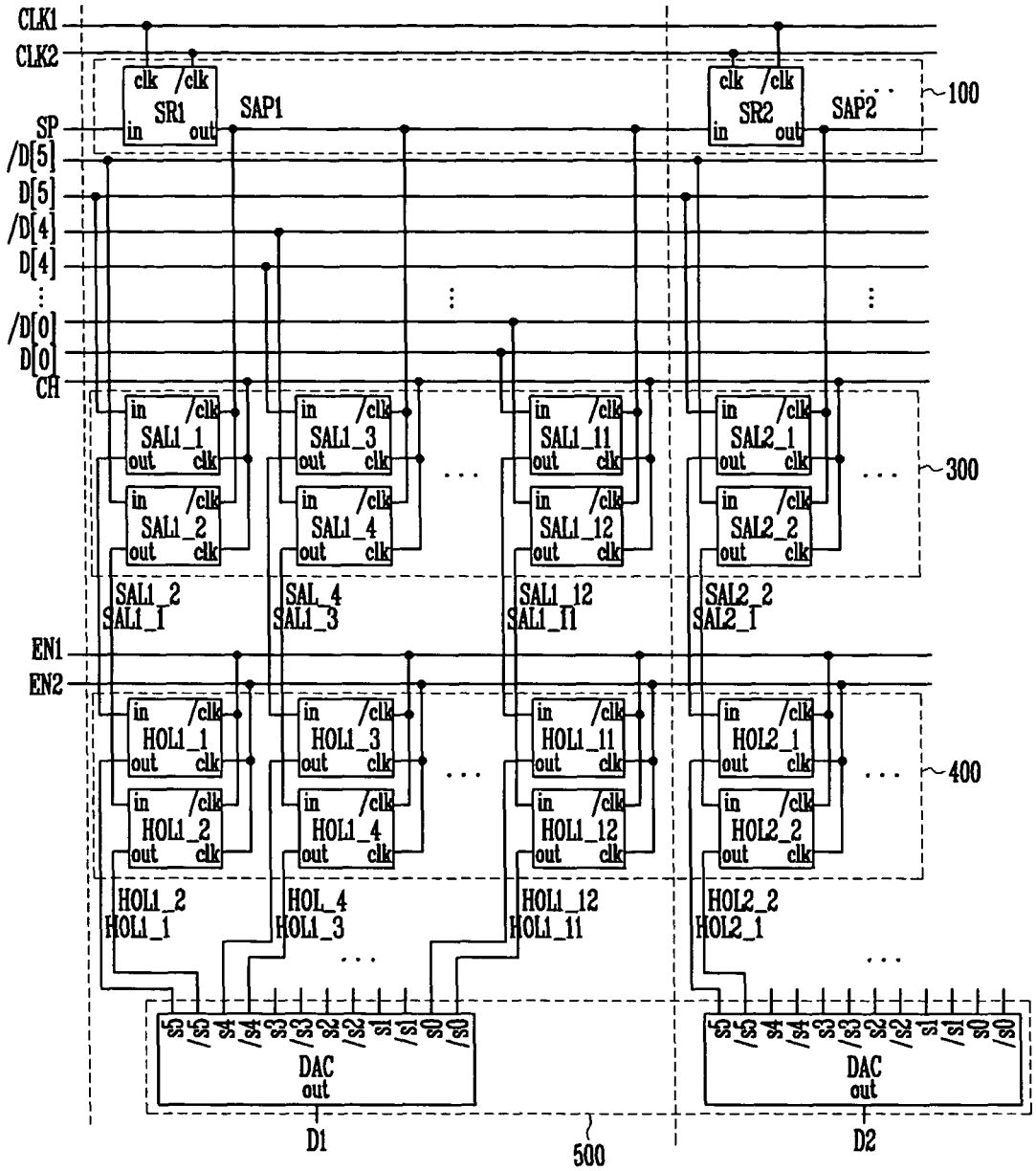
FIG. 4 illustrates a detailed block diagram of a first exemplary embodiment of a data driver of FIG. 3.
Figure 5:
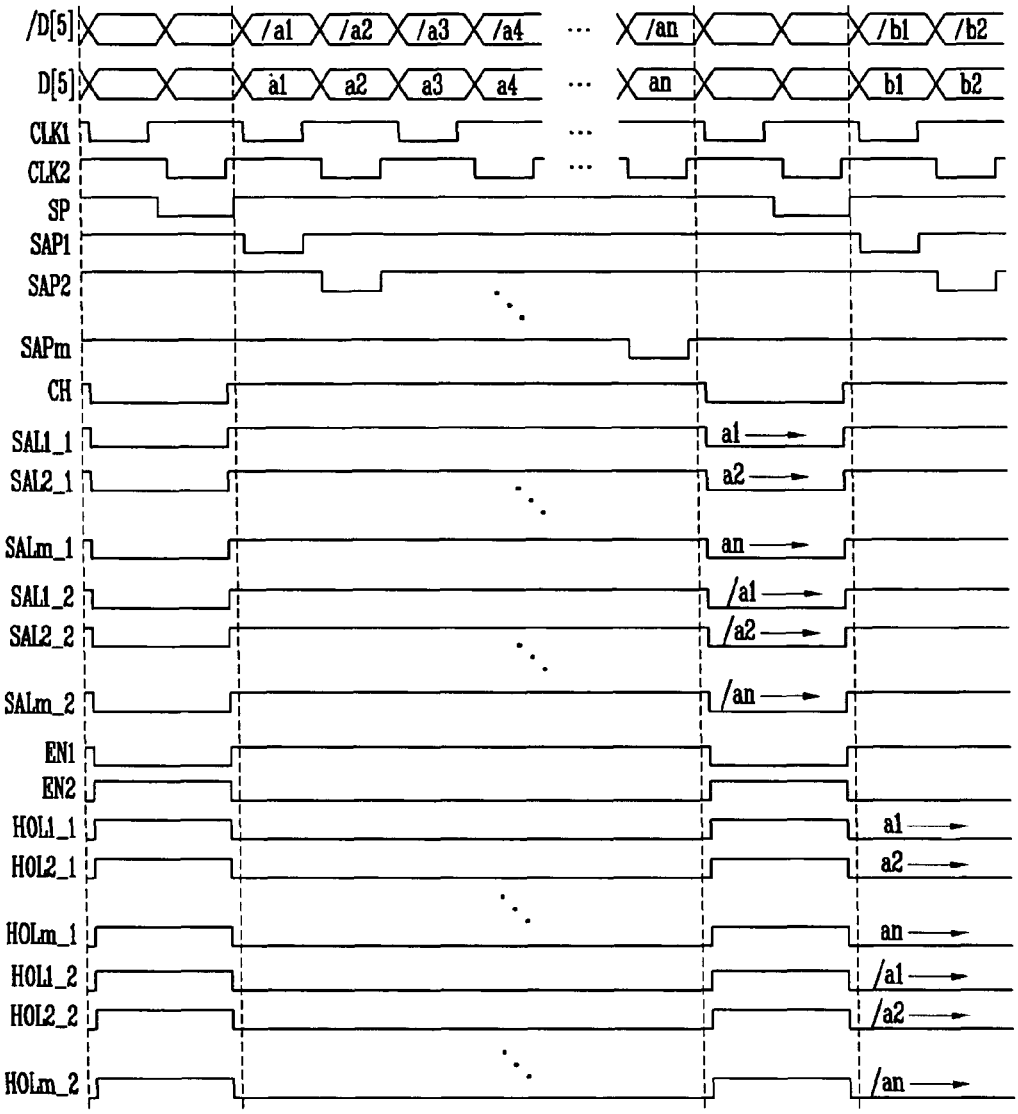
FIG. 5 illustrates a timing diagram for driving the data driver of FIG. 4.

FIG. 4 illustrates a detailed block diagram of a first exemplary embodiment of a data driver of FIG. 3, and FIG. 5 illustrates a timing diagram for driving the data driver of FIG. 4. FIG. 4 will be described assuming that the data driver includes "m" number of channels and 6-bit digital data is input. However, it is to be understood that this is merely an exemplary implementation, and the present invention is not limited thereto. Also, FIG. 5 illustrates a timing diagram in which a most significant bit and a reversed most significant bit of the digital data may be input into every channel.

Figure 6:
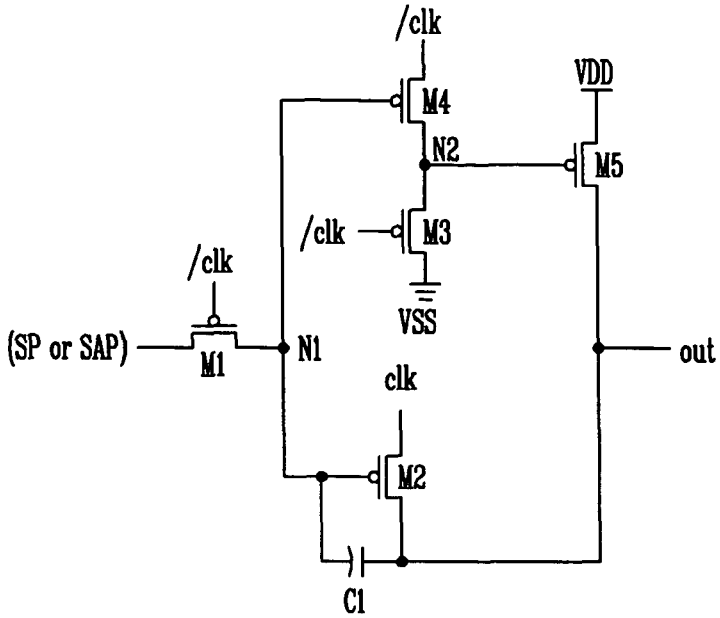
FIG. 6 illustrates a circuit diagram of an exemplary shift register provided in a shift register unit of FIG. 4.
Figure 7:
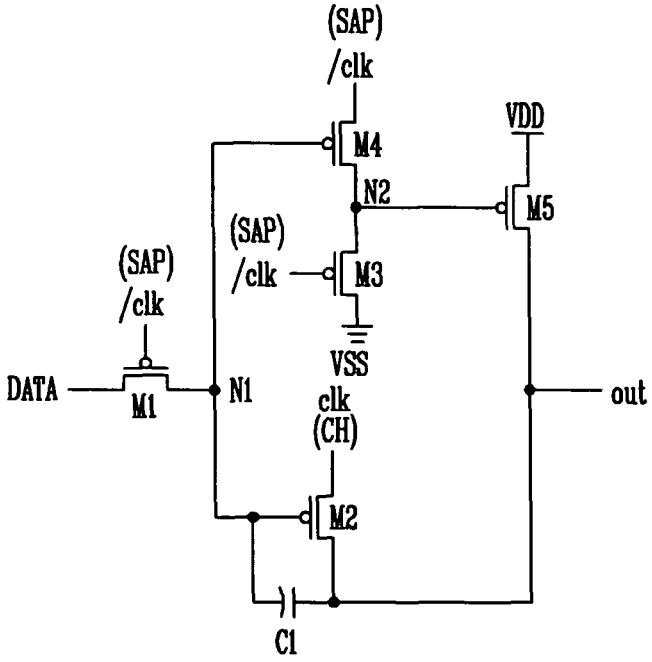
FIG. 7 illustrates a circuit diagram of an exemplary sampling latch provided in a sampling latch unit of FIG. 4.
Figure 8:
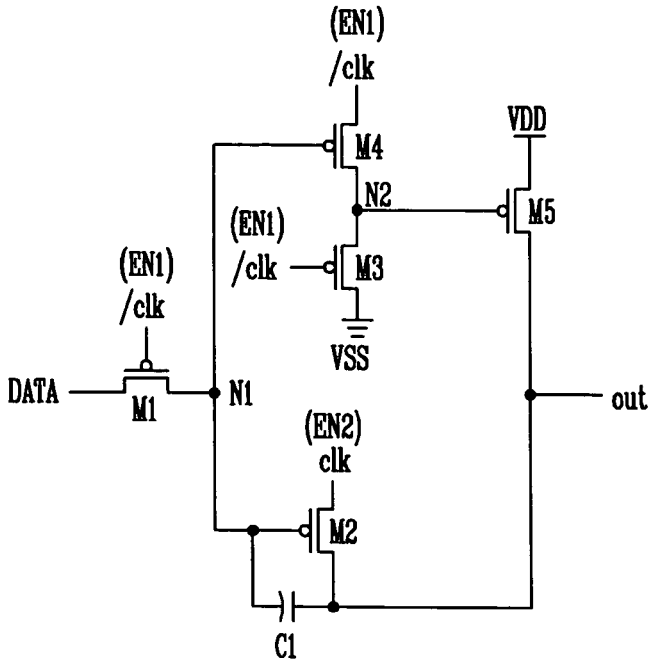
FIG. 8 illustrates a circuit diagram of an exemplary holding latch provided in a holding latch unit of FIG. 4.

Referring to FIG. 4, the shift register unit 100 may include one shift register (SR1 . . . SRm) per channel. A circuit diagram of an exemplary shift register (SR) of the shift register unit 100 in the data driver in FIG. 4 is illustrated in FIG. 6 and is described below in detail in connection with FIG. 6. The sampling latch unit 300 may include 12 sampling latches per channel, e.g., sampling latches (SAL1_1 . . . SAL1_12, . . . , SALm_1 . . . SALm_12). A circuit diagram of an exemplary sampling latch of the sampling latch unit 300 in the data driver in FIG. 4 is illustrated in FIG. 7 and is described below in detail in connection with FIG. 7. As also described below, the sampling latch may be implemented with the same circuit as the shift register (SR). The holding latch unit 400 may include 12 holding latches per channel, e.g., holding latches (HOL1_1 . . . HOL1_12, . . . , HOLm_1 . . . HOLm_12). A circuit diagram of an exemplary holding latch of the holding latch unit 400 in the data driver in FIG. 4 is illustrated in FIG. 8 and is described in detail below in connection with FIG. 8. For clarity, FIG. 4 primarily illustrates the shift registers, the sampling latches, and the holding latches for the first channel only.

Odd-numbered shift registers (SR1, SR3, . . . , SRm−1) of the shift registers (SR1 . . . SRm) may receive the first clock signal (CLK1) through respective first input terminals (clk) and may receive the second clock signal (CLK2) through respective second input terminals (/clk). Even-numbered shift registers (SR2, SR4, . . . , SRm) may receive the second clock signal (CLK2) through respective first input terminals (clk) and may receive the first clock signal (CLK1) through respective second input terminals (/clk). The first clock signal (CLK1) and the second clock signal (CLK2) may have a phase difference, e.g., about 180°. The first clock signal (CLK1) and the second clock signal (CLK2) may both be at a high level at the same time during a predetermined period, as illustrated in FIG. 5.

The first shift register (SR1) may receive the first clock signal (CLK1), the second clock signal (CLK2), and the start pulse (SP) to generate a first sampling pulse (SAP1). A second shift register (SR2) may receive a first clock signal (CLK1), a second clock signal (CLK2) and a first sampling pulse (SAP1) to generate a second sampling pulse (SAP2). That is, the shift registers (SR1 . . . SRm) may receive the start pulse (SP) or the sampling pulse (SAP) of a previous stage, so as to sequentially generate a sampling pulse (SAP), as illustrated in FIG. 5.

The sampling latches (SAL1_1 . . . SAL1_12, . . . , SALm_1 . . . SALm_12) may receive the charging signal (CH) through respective first input terminals (clk) and the sampling pulse (SAP) through respective second input terminals (/clk). The sampling latches (SAL1_1 . . . SAL1_12, . . . , SALm_1 . . . SALm_12) may also receive each bit or reversed bit of the digital data and may store each bit or reversed bit of the digital data. For example, the sampling latches (SAL1_1 . . . SAL1_12) corresponding to the first channel may receive the charging signal (CH) through the respective first input terminals (clk) and may receive the first sampling pulse (SAP1) through the respective second input terminals (/clk). The sampling latches (SAL1_1 . . . SAL1_12) may also receive each bit or reversed bit of the digital data corresponding to the first channel, and store the bit and the reversed bit of the digital data.

In an implementation, a first sampling latch (SAL1_1) provided in the first channel may receive a most significant bit, e.g., D[5] (a1 in FIG. 5) of the digital data, and may store the most significant bit D[5] of the digital data when the first sampling pulse (SAP1) and the charging signal (CH) are supplied to the first sampling latch. A second sampling latch (SAL1_2) may receive a reversed most significant bit, e.g., /D[5] (/a1 in FIG. 5) of the digital data, and may store the reversed most significant bit /D[5] when the first sampling pulse (SAP1) and the charging signal (CH) are supplied to the second sampling latch (SAL1_2).

The remaining sampling latches (SAL1_3 . . . SAL1_12) provided in the first channel may receive each bit or reversed bit (D[4], /D[4], D[3], /D[3], D[2], /D[2], D[1], /D[1], D[0], /D[0]) of the digital data, and may store the bit or the reversed bit of the digital data when the first sampling pulse (SAP1) and the charging signal (CH) are supplied to the remaining sampling latches (SAL1_3 . . . SAL1_12), in the same manner as described above. As illustrated in FIG. 5, the charging signal (CH) may be at a high level during the period when the digital data is input to the sampling latches (SAL1_1 . . . SAL1_12).

The holding latches (HOL1_1 . . . HOL1_12, . . . , HOLm_1 . . . HOLm_12) may receive the second enable signal (EN2) through respective first input terminals (clk) and may receive the first enable signal (EN1) through respective second input terminals (/clk). The holding latches (HOL1_1 . . . HOL1_12, . . . , HOLm_1 . . . HOLm_12) receiving the first enable signal (EN1) and the second enable signal (EN2) may simultaneously receive each of the bits of the digital data stored in the sampling latches (SAL1_1 . . . SAL1_12, . . . SALm_1 . . . SALm_12). The holding latches (HOL1_1 . . . HOL1_12, . . . , HOLm_1 . . . HOLm_12) may output each of the bits of the received digital data to the DAC unit 500.

In an implementation, the holding latches (HOL1_1 . . . HOL1_12) corresponding to the first channel may receive the second enable signal (EN2) through the respective first input terminals (clk) and may receive the first enable signal (EN1) through the respective second input terminals (/clk), and may simultaneously receive each bit or reversed bit of the digital data stored in the sampling latches (SAL1_1 . . . SAL1_12) corresponding to the first channel. The holding latches (HOL1_1 . . . HOL1_12) may output the bit or the reversed bit of the digital data to the DAC of the first channel.

For example, the first holding latch (HOL1_1) provided in the first channel may receive the bit D[5] stored in the first sampling latch (SAL1_1), and the second holding latch (HOL1_2) may receive the reversed bit /D[5] stored in the second sampling latch (SAL1_2). Similarly, the holding latches (HOL1_3 . . . HOL1_12) provided in the first channel may simultaneously receive each bit or reversed bit (D[4], /D[4], D[3], /D[3], D[2], /D[2], D[1], /D[1], D[0], /D[0]) of the digital data stored in the sampling latches (SAL1_3 . . . SAL1_12), and may output the bit or the reversed bit to the DAC of the first channel, in the same manner as described above.

The bit and the reversed bit respectively output from the holding latches (HOL1_1 . . . HOL1_12) may be input to each of the corresponding terminals of the DAC provided in every channel. The DACs may select one of a plurality of gray scale voltages to correspond to the bit value of the digital data supplied from the holding latches. The DACs may respectively generate an analog data signal corresponding to the selected gray scale voltage, so as to respectively supply the analog signal to the data lines (D1 . . . Dm).

FIG. 6 illustrates a circuit diagram of an exemplary shift register provided in a shift register unit of FIG. 4. Referring to FIG. 6, the shift register (SR) may receive the start pulse (SP) or the sampling pulse (SAP) of a previous stage. The shift register (SR) may include a first transistor (M1) having a gate electrode connected to a second input terminal (/clk), a second transistor (M2) connected between the first transistor (M1) and an output terminal (out), a third transistor (M3) and a fourth transistor (M4) connected respectively between a fourth power supply VSS and the second input terminal (/clk), a fifth transistor (M5) connected between a third power supply (VDD) and the output terminal (out), and a capacitor (C1) connected between a gate electrode and a second electrode of the second transistor (M2). The first through fifth transistors (M1 . . . M5) may each be a PMOS transistor. The third power supply (VDD) may have a higher voltage compared to the voltage of the fourth power supply (VSS).

A first electrode of the first transistor (M1) may receive the start pulse (SP) or the sampling pulse (SAP) of a previous stage. The first electrode may be connected to an external input terminal. The gate electrode of the first transistor (M1) may be connected to the second input terminal (/clk), and the second electrode of the first transistor (M1) may be connected to a first node (N1). The first transistor (M1) may be turned on or turned off in correspondence to a first clock signal (CLK1) or a second clock signal (CLK2) supplied to the second input terminal (/clk).

A gate electrode of the second transistor (M2) may be connected to the first node (N1), and a first electrode of the second transistor (M2) may be connected to the first input terminal (clk). The second electrode of the second transistor (M2) may be connected to the output terminal (out). The second transistor (M2) may be turned on or turned off in correspondence to a voltage of the first node (N1).

A first electrode of the third transistor (M3) may be connected to a second node (N2), and a second electrode of the third transistor (M3) may be connected to the fourth power supply (VSS). A gate electrode of the third transistor (M3) may be connected to the second input terminal (/clk). The third transistor (M3) may be turned on or turned off in correspondence to the first clock signal (CLK1) or the second clock signal (CLK2) supplied to the second input terminal (/clk).

A first electrode of the fourth transistor (M4) may be connected to the second input terminal (/clk), and a second electrode of the fourth transistor (M4) may be connected to the second node (N2). A gate electrode of the fourth transistor (M4) may be connected to the first node (N1). The fourth transistor (M4) may be turned on or turned off in correspondence to a voltage of the first node (N1).

A first electrode of the fifth transistor (M5) may be connected to the third power supply (VDD), and a second electrode of the fifth transistor (M5) may be connected to the output terminal (out). A gate electrode of the fifth transistor (M5) may be connected to the second node (N2). The fifth transistor (M5) may be turned on or turned off in correspondence to a voltage of the second node (N2).

The capacitor (C1) may be connected between the gate electrode and the second electrode of the second transistor (M2). A voltage charged in the capacitor (C1) may correspond to the start pulse (SP) or the sampling pulse (SAP) of the previous stage supplied to the first node (N1) when the first transistor (M1) may be turned on.

An exemplary operation of a shift register (SR) will now be described, taking the first shift register (SR1) as a particular example. For the sake of discussion, it will be assumed that the fourth power supply (VSS) may be a low level voltage, and the third power supply (VDD) may be a high level voltage of the clock signals (CLK1, CLK2). The fourth power supply (VSS) may have a lower voltage compared to the voltage of the third power supply (VDD). For example, the fourth power supply (VSS) may be a ground voltage.

The first transistor (M1) and the third transistor (M3) may be turned on when the first clock signal (CLK1) at a high level is input, the second clock signal (CLK2) at a low level is input, and a start pulse (SP) at a low level is be input, as illustrated in FIG. 5. If the first transistor (M1) is turned on, then the start pulse (SP) at a low level may be supplied to the first node (N1). The second transistor (M2) and the fourth transistor (M4) may be turned on.

If the fourth transistor (M4) is turned on, then a low level of the second clock signal (CLK2) may be supplied to the second node (N2). If the third transistor (M3) is turned on, then the fourth power supply (VSS) may be supplied to the second node (N2). The fifth transistor (M5) may be turned on to supply the voltage of the third power supply (VDD) to the output terminal (out). If the second transistor (M2) is turned on, then the first clock signal (CLK1) at a high level may be supplied to the output terminal (out).

At this time, a voltage corresponding to a difference between the first node (N1) and the output terminal (out) may be charged in the capacitor (C1). That is, the voltage corresponding to the difference between the low voltage of the start pulse (SP) and the third power supply (VDD) may be charged in the capacitor (C1).

Subsequently, the first clock signal (CLK1) may be at a low level, the second clock signal (CLK2) may be a high level, and the start pulse (SP) may be at a high level. The first transistor (M1) and the third transistor (M3) receiving the second clock signal (CLK2) at a high level may be turned off. The first node (N1) may be set to a low level in correspondence to the voltage charged in the capacitor (C1). The second transistor (M2) may be turned on, and a voltage of the output terminal (out) may decrease to a low level voltage of the first clock signal (CLK1). That is, a first sampling pulse (SAP1) may be generated, as illustrated in FIG. 5.

If the voltage of the first node (N1) is at a low level, the fourth transistor (M4) may be turned on. If the fourth transistor (M4) is turned on, then the second clock signal (CLK2) at a high level may be supplied to the second node (N2). Accordingly, the fifth transistor (M5) may be turned off.

Subsequently, the first clock signal (CLK1) may be at a high level, the second clock signal (CLK2) may be at a low level, and the start pulse (SP) may be at a high level. The first transistor (M1) and the third transistor (M3) receiving the second clock signal (CLK2) at a low level may be turned on. If the third transistor (M3) is turned on, then a voltage of the fourth power supply (VSS) may be supplied to the second node (N2). The fifth transistor (M5) may be turned on, and the voltage of the third power supply (VDD) may be supplied to the output terminal (out).

If the first transistor (M1) is turned on, then a high level voltage may be supplied to the first node (N1). The high level voltage may not be charged in the capacitor (C1). Accordingly, the second transistor (M2) and the fourth transistor (M4) may be turned on, although the phases of the next clock signals (CLK1, CLK2) are reversed. The shift register (SR) may output at a high level.

That is, the shift register (SR) may store a low level voltage in the capacitor (C1) during a half cycle of the clock signals (CLK1, CLK2) and output a low level voltage, i.e., the sampling pulse (SAP), during the other half cycle of the clock signals (CLK1, CLK2) when a low level voltage may be input to an external input terminal.

The second shift register (SR2) may charge a voltage corresponding to a first sampling pulse (SAP1) in the capacitor (C1) when the first clock signal (CLK1) at a low level, the second clock signal (CLK2) at a high level, and the first sampling pulse (SAP1) may be input. The second shift register (SR2) may output a second sampling pulse (SAP2) when the first clock signal (CLK1) may be at a high level, and the second clock signal (CLK2) may be at a low level. The shift registers (SR1 . . . SRm) may sequentially output sampling pulses (SAP1 to SAPm) by repeating this operation, as described above.

As illustrated in FIG. 5, when the first and the second clock signals (CLK1, CLK2) are both at a high level, the previous output may be maintained if, during the previous procedure, the first clock signal (CLK1) was at a low level and the second clock signal (CLK2) was at a high level. Also, since many of the high levels of the first and second clock signals (CLK1, CLK2) may overlap, i.e., be high at the same time, a gap may be generated between output pulses of the adjacent shift registers (SR) because the output is at a high level if the first clock signal (CLK1) is at a high level and the second clock signal (CLK2) is at a low level.

FIG. 7 illustrates a circuit diagram of an exemplary sampling latch provided in a sampling latch unit of FIG. 4. The first sampling latches (SAL1_1, SAL2_1, . . . , SALm_1) of the sampling latches (SAL1_1 . . . SAL1_12, . . . , SALm_1 . . . SALm_12). The first sampling latches ($SAL1_{_1}$, $SAL2_{_1}$, . . . , $SALm_{_1}$) may receive a most significant bit, e.g., the bit D[5]. Referring to FIG. 7, each of the sampling latches (SAL1_1 . . . SAL1_12, . . . , SALm_1 . . . SALm_12), as illustrated in FIG. 4, may be implemented with the same circuit as the shift register (SR), as illustrated in FIG. 6 and as noted above in connection with FIG. 4. However, the sampling latches (SAL1_1 . . . SAL1_12, . . . , SALm_1 . . . SALm_12) may receive the charging signal (CH) through the respective first input terminals (clk), and may receive the sampling pulse (SAP) through the respective second input terminal (/clk).

An exemplary operation of the first sampling latch (SAL1_1) in the first channel will now be described in connection with the timing diagram illustrated in FIG. 5. The first sampling latch (SAL1_1) may receive a most significant bit, e.g., the bit D[5] (a1 of FIG. 5), when the first sampling pulse (SAP1) is at a low level and the charging signal (CH) is at a high level. The bit D[5] input to the first sampling latch (SAL1_1) may be stored in the capacitor (C1). The fifth transistor (M5) may be turned on, since the first sampling pulse (SAP1) may be at a low level. Accordingly, a high level voltage may be output from the output terminal (out).

Subsequently, if the first sampling pulse (SAP1) is at a high level, and the charging signal (CH) is at a high level, then a voltage corresponding to the D[5] may be output through the output terminal (out). For example, a low level voltage may be output through the output terminal (out) if the bit D[5] (a1) is a low level voltage, and a high level voltage may be output through the output terminal (out) if the bit D[5] (a1) is a high level voltage.

In the same manner as described above, the first sampling latch (SAL2_1) provided in the second channel may also receive a most significant bit, e.g., the bit D[5] (a2 of FIG. 5) of the digital data when the second sampling pulse (SAP2) is at a low level and the charging signal (CH) is at a high level. The bit D[5] of the digital data may be stored in the capacitor (C1). Subsequently, the second sampling pulse (SAP2) may be at a high level, the charging signal (CH) may be at a low level, and a voltage corresponding to the bit D[5] may be output through the output terminal (out).

The second sampling latch (SAL2_2) may receive the reversed bit /D[5] (/a1, /a2, . . . , /an in FIG. 5), and may store the reversed bit /D[5] in the capacitor (C1) when each of the sampling pulses (SAP1, SAP2, . . . , SAPm) are at a low level and the charging signal (CH) is at a high level. Thus, the second sampling latch (SAL2_2) may operate in the same manner as the first sampling latches (SAL1_1, SAL2_1, . . . , SALm_1) provided in each of the channels. The voltage corresponding to the reversed bit /D[5] may be output from the output terminal (out) if the sampling pulses (SAP1, SAP2, . . . , SAPm) are at a high level and the charging signal (CH) is at a low level.

The sampling latches (SAL1_1 . . . SAL1_12, . . . , SALm_1 . . . SALm_12) may receive a bit or a reversed bit of the digital data when a sampling pulse (SAP) and a charging signal (CH) are supplied to the sampling latches (SAL1_1 . . . SAL1_12, . . . , SALm_1 . . . SALm_12). The sampling latches (SAL1_1 . . . SAL1_12, . . . SALm_1 . . . SALm_12) may output a voltage corresponding to the received bit through the output terminal (out).

FIG. 8 illustrates a circuit diagram of an exemplary holding latch provided in a holding latch unit of FIG. 4. Referring to FIG. 8, each of the holding latches (HOL1_1 . . . HOL1_12, . . . , HOLm_1 . . . HOLm_12), as illustrated in FIG. 4, may be implemented with the same circuit as the shift register (SR), as illustrated in FIG. 6 and as noted above in connection with FIG. 4. However, the holding latches (HOL1_1 . . . HOL1_12, . . . , HOLm_1 . . . HOLm_12) may receive the second enable signal (EN2) through the respective first input terminals (clk), and may receive the first enable signal (EN1) through the respective second input terminals (/clk).

An exemplary operation will now be described in connection with the timing diagram illustrated in FIG. 5. When the sampling latches (SAL1 . . . SALm) output the digital data, the first enable signal (EN1) may be at a low level and the second enable signal (EN2) may be at a high level, as illustrated in FIG. 5. Subsequently, each of the holding latches may receive a data bit output from each of the sampling latches (SAL1 to SALm). The data bits input to the holding latches may be stored in the capacitor (C1) included in each of the holding latches.

Then, if the first enable signal (EN1) may be at a high level, and the second enable signal (EN2) may be at a low level, each of the holding latches (HOL1_1 . . . HOL1_12, . . . , HOLm_1 . . . HOLm_12) may output a voltage (high or low) corresponding to the data bit stored in each of the holding latches (HOL1_1 . . . HOL1_12, . . . , HOLm_1 . . . HOLm_12) to the DAC unit 500.

For example, the first holding latch (HOL1_1) provided in the first channel may receive the bit D[5] (a1 of FIG. 5) output from the first sampling latch (SAL1_1), and then store the bit D[5] in the capacitor (C1) when the first enable signal (EN1) is at a low level and the second enable signal (EN2) is at a high level. Subsequently, if the first enable signal (EN1) is at a high level, and the second enable signal (EN2) is at a low level, then the first holding latch (HOL1_1) may output a voltage (high or low) corresponding to the stored D[5] (a1) to the DAC of the first channel.

In the same manner as described above, the first holding latch (HOL2_1) provided in the second channel may also receive the bit D[5] output from the first sampling latch (SAL2_1) and may store the bit D[5] in the capacitor (C1) when the first enable signal (EN1) is at a low level and the second enable signal (EN2) is at a high level. The first holding latch (HOL1_1) may output a voltage (high or low) corresponding to the stored bit D[5] to the DAC of the first channel when the first enable signal (EN1) is at a high level and the second enable signal (EN2) is at a low level.

The second holding latch (HOL2_2) may output a voltage corresponding to the reversed bit /D[5] to the DAC of the second channel during the above-mentioned operation, since it may operate in the same manner as the first holding latches (HOL1_1, HOL2_1, . . . , HOLm_1) provided in each of the channels.

Figure 9:
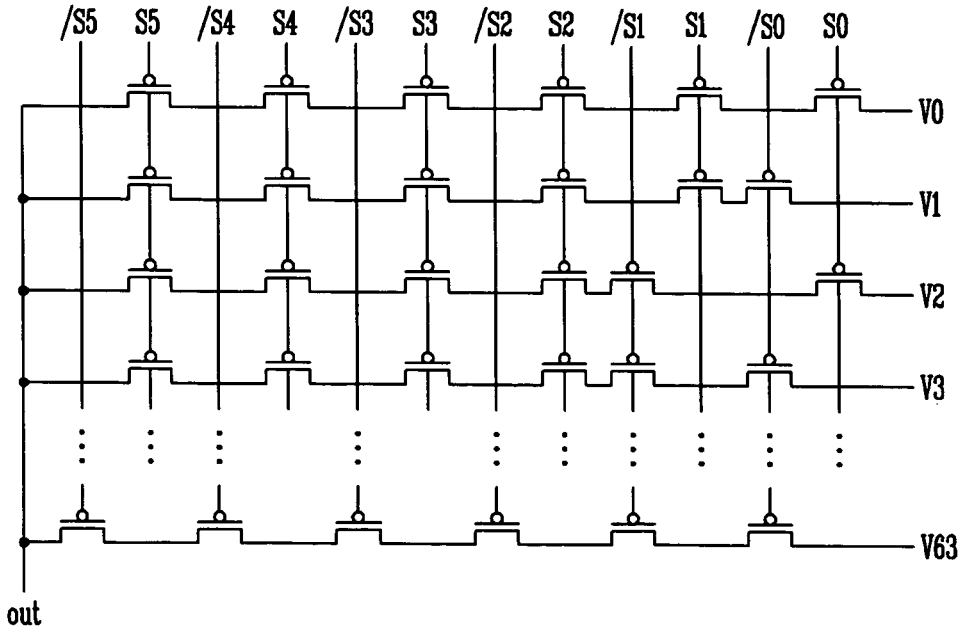
FIG. 9 illustrates a circuit diagram of an exemplary digital-to-analog converter (DAC) unit of FIG. 4.

FIG. 9 illustrates a circuit diagram of an exemplary digital-to-analog converter (DAC) unit of FIG. 4. For the sake of discussion, an exemplary DAC will be described assuming that it receives 6-bit digital data. Referring to FIG. 9, the DAC may be implemented using only PMOS transistors. The DAC may receive each bit and reversed bit of the 6-bit digital data output through the holding latch. The DAC may select one of a plurality of gray scale voltages to correspond to the bit and the reversed bit of the 6-bit digital data, and may generate an analog data signal corresponding to one of a plurality of gray scale voltages to supply the analog data signal to a data line, e.g., data line D1.

For example, if the input digital data is [000000], then V0 of the gray scale voltages may be selected and output. If the input digital data is [000001], then V1 of the gray scale voltages may be selected and output. If the input digital data is [111111], then V63 of the gray scale voltages may be selected and output. Therefore, a total of 64 gray scale voltages may be displayed if the 6-bit digital data is input. That is, a gray scale voltage corresponding to a specific digital data may be supplied to a data line corresponding to the specific digital data if the gray scale voltage corresponding to the specific digital data is selected.

FIG. 5 is described with reference to the above-mentioned operation of the shift registers (S/R), the sampling latches (SAL), the holding latches (HOL) and the DACs, as follows. It is assumed, however, that a most significant bit and a reversed most significant bit are input into every channel.

The odd-numbered shift registers (SR1, SR3, . . . ) may charge a voltage corresponding to the start pulse (SP) or the sampling pulse (SAP) of a previous stage when the second clock signal (CLK2) is at a low level, and may output a low level voltage to correspond to the start pulse (SP) or the sampling pulse (SAP) of the previous stage charged when the second clock signal (CLK2) is at a high level. The even-numbered shift registers (SR2, SR4, . . . ) may charge a voltage corresponding to the sampling pulse (sap) of the previous stage, when the first clock signal (CLK1) may be at a low level, and may output a low level voltage to correspond to the sampling pulse (sap) charged, when the first clock signal (CLK1) may be at a high level. Accordingly, the shift registers (SR1 . . . SRm) may sequentially generate sampling pulses (SAP1 to SAPm), as illustrated in FIG. 5.

As illustrated in FIG. 5, when the first and second clock signals (CLK1, CLK2) are both at a high level the previous output may be maintained if, during the previous procedure, the first clock signal (CLK1) was at a low level and the second clock signal (CLK2) was at a high level. Also, since many of the high levels of the first and second clock signals (CLK1, CLK2) overlap, i.e., CLK1 and CLK2 are high at the same time, a gap may be generated between output pulses of the adjacent shift registers (SR) because the output is at a high level if the first clock signal (CLK1) is at a high level and the second clock signal (CLK2) is at a low level, as discussed previously.

Each of the first and second sampling latches (SAL1_1, SAL1_2, . . . , SALm_1, SALm_2) provided in every channel may receive a most significant bit (D[5]) or a reversed most significant bit (/D[5]) and store the most significant bit (D[5]) or the reversed most significant bit (/D[5]) when the charging signal (CH) is at a high level and a sampling pulse (any one of SAP1 to SAPm) is supplied to the first and second sampling latches (SAL1_1, SAL1_2, . . . , SALm_1, SALm_2). Subsequently, the first and the second sampling latches (SAL1_1, SAL1_2, . . . , SALm_1, SALm_2) may simultaneously output a voltage corresponding to the stored data bit when the sampling pulse (any one of SAP1 to SAPm) is at a high level and the charging signal (CH) is at a low level.

That is, the first and the second sampling latches (SAL1_1, SAL1_2, . . . , SALm_1, SALm_2) may receive the bit D[5] and the reversed bit /D[5] and store the bit D[5] and the reversed bit /D[5] in the capacitor (C1) when each of the sampling pulse (SAP1, SAP2, . . . , SAPm) is at a low level and the charging signal (CH) is at a high level. Subsequently, the voltage corresponding to the bit D[5] and the reversed bit /D[5] may be simultaneously output through the output terminal (out) when each of the sampling pulses (SAP1, SAP2, . . . , SAPm) are at a high level and the charging signal (CH) is at a low level.

Each of the first and the second holding latches (HOL1_1, HOL1_2, . . . , HOLm_1, HOLm_2) may receive a data bit output from the first and the second sampling latches (SAL1_1, SAL1_2, . . . , SALm_1, SALm_2) when the first enable signal (EN1) is at a low level and the second enable signal (EN2) is at a high level. Also, each of the first and the second holding latches (HOL1_1, HOL1_2, . . . , HOLm_1, HOLm_2) may output a high level voltage or a low level voltage to the DACs, to correspond to the digital data stored in the first and second holding latches (HOL1_1, HOL1_2, . . . , HOLm_1, HOLm_2), when the first enable signal (EN1) is at a high level and the second enable signal (EN2) is at a low level.

The bit and the reversed bit respectively output from the holding latches may be input to each of the corresponding terminals of the DACs provided in every channel. The DACs may select one of a plurality of gray scale voltages to correspond to a bit value of the data supplied from the holding latches. The DACs may respectively generate an analog data signal corresponding to the selected gray scale voltage, so as to respectively supply the analog data signal to the data lines (D1 to Dm).

The data driver 20 may be implemented using only PMOS transistors, as described above. The data driver 20 may be mounted in a panel and therefore the manufacturing cost of a display incorporating the same may be reduced.

Figure 10:
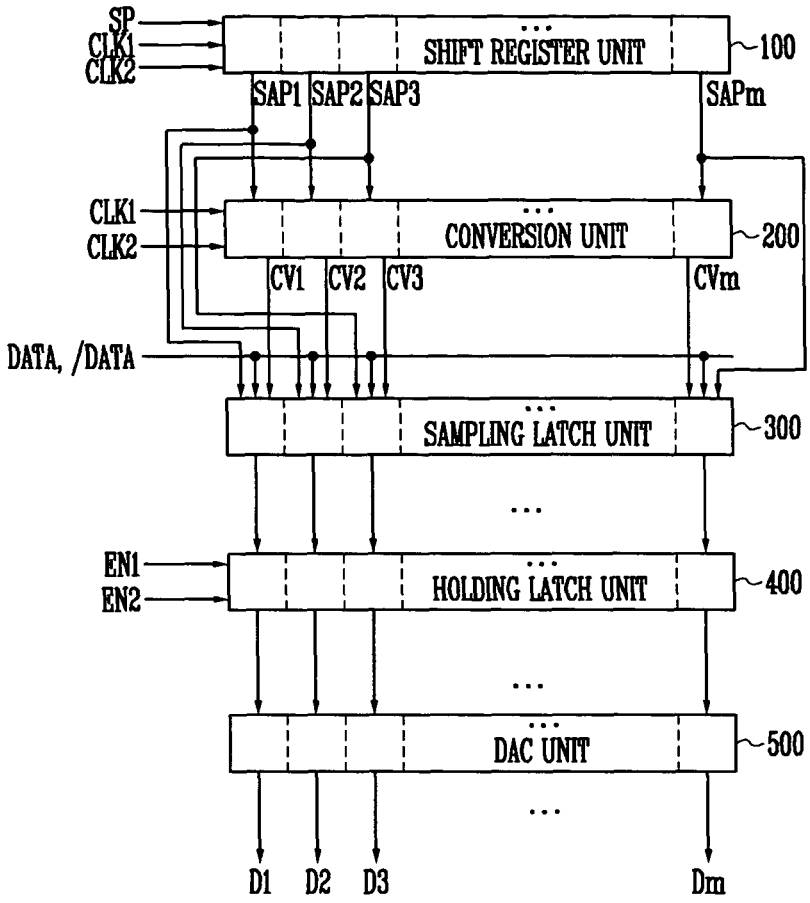
FIG. 10 illustrates a basic block diagram of a second exemplary embodiment of a data driver of FIG. 1.

FIG. 10 illustrates a basic block diagram of a second exemplary embodiment of a data driver of FIG. 1. The data driver will be described assuming that it includes "m" channels. Referring to FIG. 10, the data driver 20' may include a shift register unit 100, a conversion unit 200, a sampling latch unit 300, a holding latch unit 400, and a DAC unit 500. The conversion unit 200 is an additional element as compared to the data driver 20 illustrated in FIG. 3. The conversion unit 200 may output a conversion signal (CV). The charging signal (CH) may not be used.

The shift register unit 100 may receive the start pulse (SP), the first clock signal (CLK1), and the second clock signal (CLK2) to sequentially generate the sampling pulse (SAP). The shift register unit 100 may include "m" shift registers.

The conversion unit 200 may receive the first clock signal (CLK1), the second clock signal (CLK2), and the sampling pulse (SAP) to sequentially generate a conversion signal (CV). The conversion unit 200 may include "m" conversion circuits.

The sampling latch unit 300 may receive the sampling pulse (SAP) and the conversion signal (CV). The sampling latch unit 300 may also receive each bit and reversed bit of the input digital data, and then may store the bit and the reversed bit. Accordingly, the sampling latch unit 300 may include twice as many sampling latches as the number of bits of the input digital data. For example, if 6-bit digital data is input, then the sampling latch unit 300 may include 12 (=6×2) sampling latches in every channel. Each sampling latch may store the bit (DATA) or the reversed bit (/DATA).

The holding latch unit 400 may receive the first enable signal (EN1) and the second enable signal (EN2). The holding latch unit 400 may simultaneously receive each bit and reversed bit output from the sampling latch unit 300. The holding latch unit 400 may output each bit and reversed bit to the DAC unit 500. Accordingly, similar to the sampling latch unit 300, the holding latch unit 400 also may include twice as many holding latches as the number of bits of the digital data input into every channel. For example, if 6-bit digital data is input, then the holding latch unit 400 may include 12 (=6×2) holding latches in every channel.

The DAC unit 500 may generate an analog signal corresponding to each bit value of the digital data output from the holding latch unit 400. That is, the DAC unit 500 may select one of a plurality of gray scale voltages to correspond to the bit value of the digital data supplied from the holding latch unit 400 and generates an analog data signal. The DAC unit 500 may supply analog data signals to the data lines (D1 to Dm), respectively. The DAC unit 500 may include "m" number of DACs.

Figure 11:
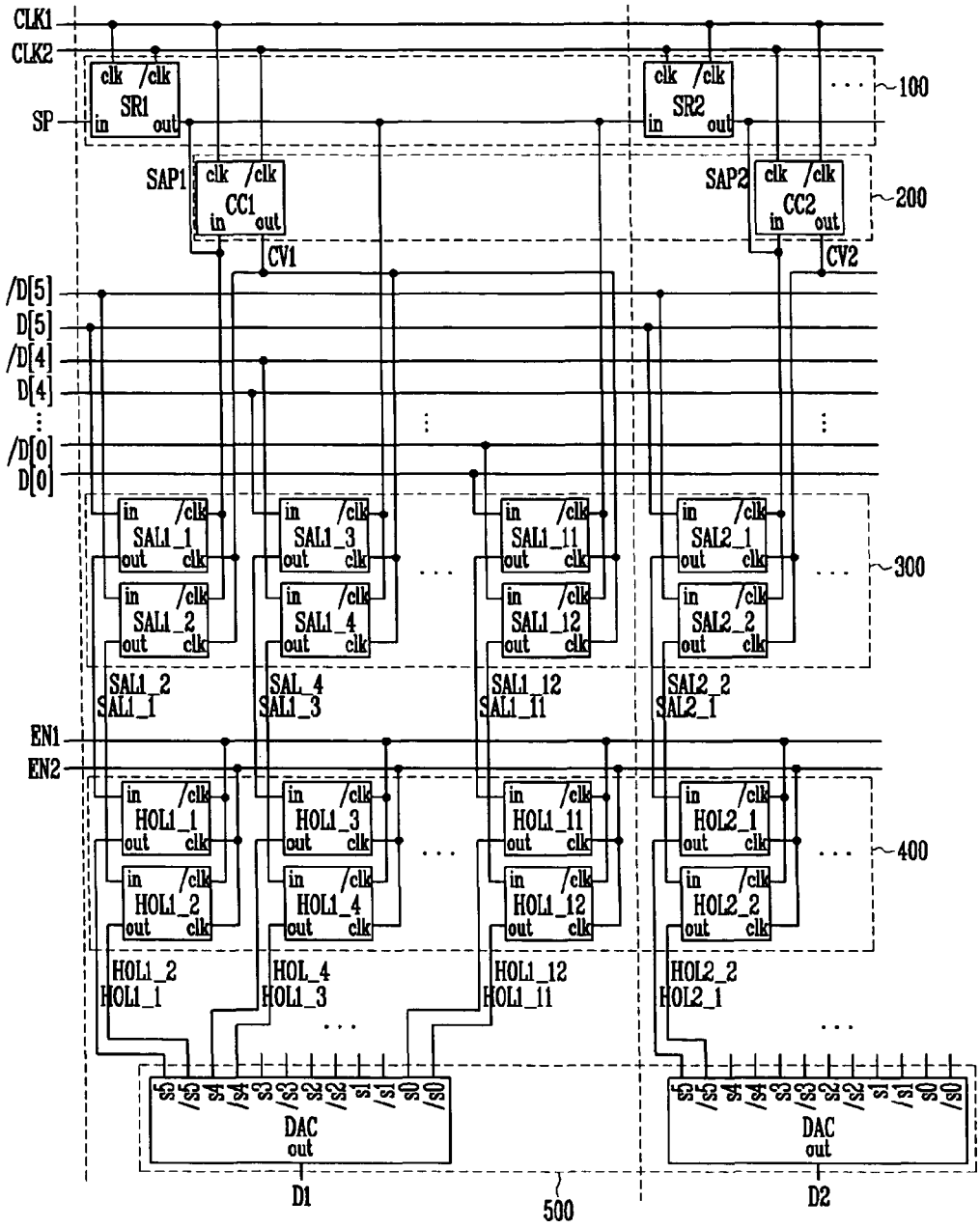
FIG. 11 illustrates a detailed block diagram of a second exemplary embodiment of a data driver of FIG. 10.
Figure 12:
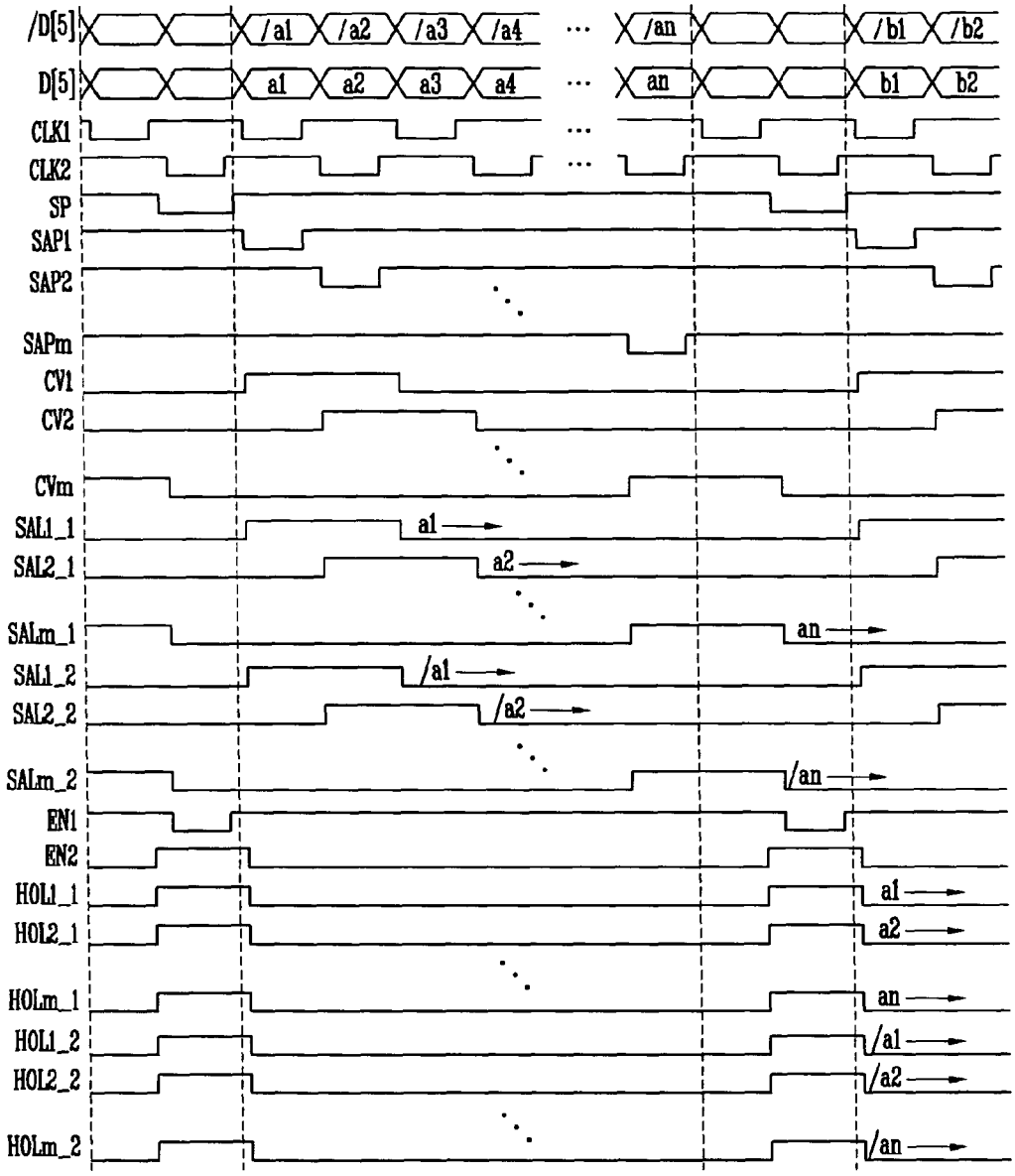
FIG. 12 illustrates a timing diagram for driving a data driver of FIG. 11.

FIG. 11 illustrates a detailed block diagram of a second exemplary embodiment of a data driver of FIG. 10, and FIG. 12 illustrates a timing diagram for driving a data driver of FIG. 11. FIG. 10 will be described assuming that the data driver has "m" number of channels and 6-bit digital data is input. However, it is to be understood that the present invention is not limited thereto. FIG. 12 illustrates a timing diagram in which a most significant bit and a reversed most significant bit of the digital data may be input into every channel.

As previously discussed above, the conversion unit 200 may be included between the shift register unit and the sampling latch unit, and may output the conversion signal (CV). Thus, the charging signal (CH) may not be used. Accordingly, the second exemplary embodiment may differ from the first embodiment previously described in connection with FIGS. 4 and 5. A specific operation may be the same as the first embodiment, as described above.

Referring to FIG. 11, the shift register unit 100 and the conversion unit 200 may include one of shift registers (SR1 . . . SRm) and one of conversion circuits (CC1 . . . CCm) per channel, respectively. The sampling latch unit 300 may include 12 sampling latches (SAL1_1 . . . SAL1_12, . . . , SALm_1 . . . SALm_12) per channel and the holding latch unit 400 may include 12 holding latches (HOL1_1 . . . HOL1_12, . . . , HOLm_1 . . . HOLm_12) per channel. For clarity, a configuration of the first channel is primarily illustrated in FIG. 11.

Odd-numbered shift registers (SR1, SR3, . . . ) of the shift registers (SR1 . . . SRm) may receive the first clock signal (CLK1) through respective first input terminals (clk) and may receive the second clock signal (CLK2) through respective second input terminals (/clk). Even-numbered shift registers (SR2, . . . , SRm) of the shift registers (SR1 . . . SRm) may receive the second clock signal (CLK2) through respective first input terminals (clk) and may receive the first clock signal (CLK1) through respective second input terminals (/clk). The first clock signal (CLK1) and the second clock signal (CLK2) may have a phase difference, e.g., about 180°. The first clock signal (CLK1) and the second clock signal (CLK2) may both be at a high level at the same time during a predetermined period, as illustrated in FIG. 12.

The first shift register (SR1) of the shift registers (SR1 . . . SRm) may receive the first clock signal (CLK1), the second clock signal (CLK2), and the start pulse (SP) to generate the first sampling pulse (SAP1). The second shift register (SR2) may receive the first clock signal (CLK1), the second clock signal (CLK2), and the first sampling pulse (SAP1) to generate the second sampling pulse (SAP2). That is, the shift registers (SR1 . . . SRm) may receive the start pulse (SP) or the sampling pulse (SAP) of a previous stage so as to sequentially generate the sampling pulse (SAP), as illustrated in FIG. 12.

The odd-numbered conversion circuits (CC1, CC3, . . . ) of the conversion circuits (CC1 . . . CCm) may receive the first clock signal (CLK1) through the respective first input terminals (clk) and may receive the second clock signal (CLK2) through the respective second input terminals (/clk). The even-numbered conversion circuits (CC2, CC4, . . . ) may receive the second clock signal (CLK2) through the respective first input terminals (clk) and may receive the first clock signal (CLK1) through the respective second input terminals (/clk).

The conversion circuits (CC1 . . . CCm) may receive the sampling pulse (SAP), the first clock signal (CLK1), and the second clock signal (CLK2) to generate the conversion signal (CV). For example, a first conversion circuit (CC1) may receive the first sampling pulse (SAP1), the first clock signal (CLK1), and the second clock signal (CLK2) to generate the first conversion signal (CV1). The second conversion circuit (CC2) may receive the second sampling pulse (SAP2), the first clock signal (CLK1), and the second clock signal (CLK2) to generate the second conversion signal (CV2). As illustrated in FIG. 12, the first conversion signal (CV1) and the second conversion signal (CV2) may overlap during a predetermined period.

The sampling latches (SAL1_1 . . . SAL1_12, . . . , SALm_1 . . . SALm_12) may receive the conversion signal (CV) through the respective first input terminals (clk) and may receive the sampling pulse (SAP) through the respective second input terminals (/clk). The sampling latches (SAL1_1 . . . SAL1_12, . . . , SALm_1 . . . SALm_12) may also receive a bit or a reversed bit of the digital data and store the bit or the reversed bit of the digital data.

For example, the sampling latches (SAL1_1 . . . SAL1_12) corresponding to the first channel may receive the first conversion signal (CV1) through the respective first input terminals (clk) and may receive the first sampling pulse (SAP1) through the respective second input terminals (/clk). The sampling latches (SAL1_1 . . . SAL1_12) may receive the bit or the reversed bit of the digital data corresponding to the first channel and store the bit or the reversed bit of the digital data.

In an implementation, the first sampling latch (SAL1_1) provided in the first channel may receive a most significant bit of the digital data, e.g., bit D[5] (a1 in FIG. 12), and may store the bit D[5] of the digital data when the first sampling pulse (SAP1) and the first conversion signal (CV1) are supplied to the first sampling latch. The second sampling latch (SAL1_2) may receive a reversed most significant bit, e.g., bit /D[5] (/a1 in FIG. 12) of the digital data, and may store the reversed most significant bit /D[5] when the first sampling pulse (SAP1) and the first conversion signal (CV1) are supplied to the second sampling latch (SAL1_12).

The remaining sampling latches (SAL1_3 . . . SAL1_12) provided in the first channel also may receive a bit or a reversed bit of the digital data, e.g., bits D[4], /D[4], D[3], /D[3], D[2], /D[2], D[1], /D[1], D[0], /D[0], and may store the bit or the reversed bit when the first sampling pulse (SAP1) and the first conversion signal (CV1) are supplied to the remaining sampling latches (SAL1_3 . . . SAL1_12), in the same manner as described above.

The holding latches (HOL1_1 . . . HOL1_12, . . . , HOLm_1 . . . HOLm_12) may receive the second enable signal (EN2) through the respective first input terminals (clk) and may receive the first enable signal (EN1) through the respective second input terminals (/clk). The holding latches (HOL1_1 . . . HOL1_12, . . . , HOLm_1 . . . HOLm_12) receiving the first enable signal (EN1) and the second enable signal (EN2) may simultaneously receive each of the bits of the digital data (DATA) stored in the sampling latches (SAL1_1 . . . SAL1_12, . . . SALm_1 . . . SALm_12). The holding latches (HOL1_1 . . . HOL1_12, . . . HOLm_1 . . . HOLm_12) may output each of the bits of the received digital data to the DAC unit 500.

In an implementation, the holding latches (HOL1_1 . . . HOL1_12) corresponding to the first channel may receive the second enable signal (EN2) through the respective first input terminals (clk) and may receive the first enable signal (EN1) through the respective second input terminals (/clk), and may simultaneously receive each bit or reversed bit of the digital data stored in the sampling latch (SAL1_1 . . . SAL1_12) corresponding to the first channel. The holding latches (HOL1_1 . . . HOL1_12) may output the bit or the reversed bit of the digital data to the DAC of the first channel.

For example, the first holding latch (HOL1_1) provided in the first channel may receive the bit D[5] stored in the first sampling latch (SAL1_1) and the second holding latch (HOL1_12) may receive the reversed bit /D[5] stored in the second sampling latch (SAL1_12). Similarly, the holding latches (HOL1_3 . . . HOL1_12) provided in the first channel may simultaneously receive each bit or reversed bit D[4], /D[4], D[3], /D[3], D[2], /D[2], D[1], /D[1], D[0], /D[0] stored in the sampling latches (SAL1_3 . . . SAL1_12) and may output the bit or the reversed bit to the DAC of the first channel, in the same manner as described above.

The bit and the reversed bit of the digital data respectively output from the holding latches may be input to each of the corresponding terminals of the DAC provided in every channel. The DACs may select one of a plurality of gray scale voltages to correspond to the bit value of the digital data supplied from the holding latches. The DACs may respectively generate an analog data signal corresponding to the selected gray scale voltage, so as to respectively supply the analog signal to the data lines (D1 . . . Dm).

Figure 13:
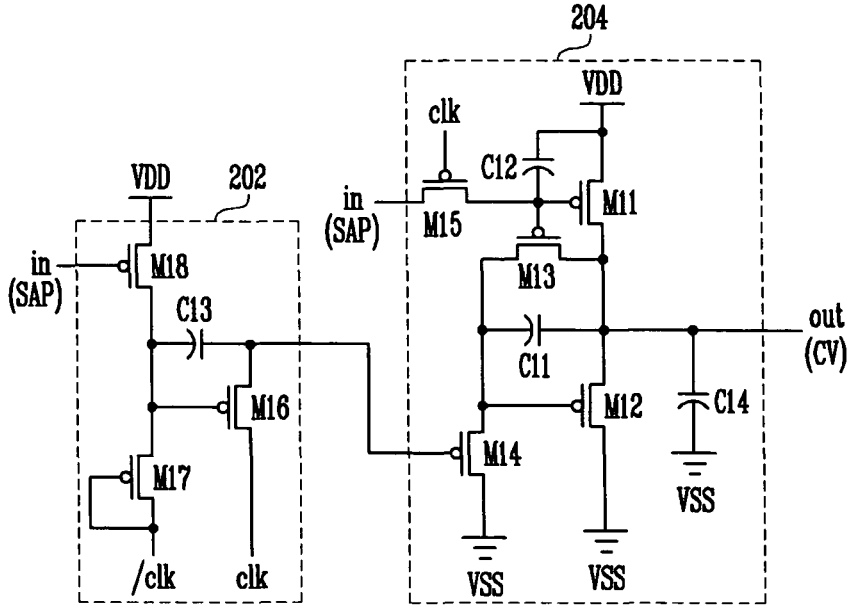
FIG. 13 illustrates a circuit diagram of an exemplary conversion circuit of FIG. 11.

FIG. 13 illustrates a circuit diagram of an exemplary conversion circuit of FIG. 11. Referring to FIG. 13, each of the conversion circuits (CC1 . . . CCm) may include an input unit 202 and an output unit 204. Transistors (M11 through M18) included in the input and output units 202 and 204 may be PMOS-type transistors, i.e., each transistor may be PMOS.

The output unit 204 may control whether or not a conversion signal (CV) may be output that corresponds to a high level or a low level voltage input from the input unit 202, a state of clock signals (CLK1 or CLK2) input through the first input terminal (clk), and a sampling pulse (SAP) input through the third input terminal (in).

The output unit 204 may include an eleventh transistor (M11) connected between a third power supply (VDD) and an output terminal (out), a twelfth transistor (M12) and a fourteenth capacitor (C14) connected between the output terminal (out) and the fourth power supply (VSS), a thirteenth transistor (M13) and an eleventh capacitor (C11) connected between a gate electrode and a first electrode of the twelfth transistor (M12), a fourteenth transistor (M14) connected to a gate electrode of the twelfth transistor (M12) and an output terminal of the input unit 202, a fifteenth transistor (M15) connected between a third input terminal (in) and the eleventh transistor (M11), and a twelfth capacitor (C12) connected between a gate electrode and a first electrode of the eleventh transistor (M11).

The gate electrode of the eleventh transistor (M11) may be connected to a second electrode of the fifteenth transistor (M15) and one terminal of the twelfth capacitor (C12), and the first electrode of the eleventh transistor (M1) may be connected to the third power supply (VDD). The second electrode of the eleventh transistor (M11) may be connected to the output terminal (out). The eleventh transistor (M11) may be turned on or turned off in accordance with a voltage input from the third input terminal (in), or a voltage stored in the twelfth capacitor (C12) when the fifteenth transistor (M15) is turned on.

The twelfth capacitor (C12) may be connected between the first electrode and the gate electrode of the eleventh transistor (M11). A voltage corresponding to a turned-on or turned-off state of the eleventh transistor (M1) may be charged in the twelfth capacitor (C12). For example, if the eleventh transistor (M11) is turned on, then a voltage capable of turning on the eleventh transistor (M11) may be charged in the twelfth capacitor (C12), and if the eleventh transistor (M11) is turned off, then a voltage capable of turning off the eleventh transistor (M11) may be charged in the twelfth capacitor (C12)

The gate electrode of the twelfth transistor (M12) may be connected to a first electrode of the fourteenth transistor (M14), one terminal of the eleventh capacitor (C11), and a second electrode of the thirteenth transistor (M13). The first electrode of the twelfth transistor (M12) may be connected to the output terminal (out), and the second electrode of the twelfth transistor (M12) may be connected to the fourth power supply (VSS). The twelfth transistor (M12) may be turned on or turned off in accordance with a voltage supplied to the gate electrode of the twelfth transistor (M12).

The eleventh capacitor (C11) may be connected between the first electrode and the gate electrode of the twelfth transistor (M12). A voltage corresponding to a turned-on or turned-off state of the twelfth transistor (M12) may be charged in the eleventh capacitor (C11). For example, if the twelfth transistor (M12) is turned on, then a voltage capable of turning on the twelfth transistor (M12) may be charged in the eleventh capacitor (C11), and if the twelfth transistor (M12) is turned off, then a voltage capable of turning off the twelfth transistor (M12) may be charged in the eleventh capacitor (C11).

The gate electrode of the thirteenth transistor (M13) may be connected to the gate electrode of the eleventh transistor (M11), and the first electrode of the thirteenth transistor (M13) may be connected to the second electrode of the eleventh transistor (M11). The second electrode of the thirteenth transistor (M13) may be connected to the gate electrode of the twelfth transistor (M12). The thirteenth transistor (M13) may control a voltage supplied to the gate electrode of the twelfth transistor (M12) while being turned on or turned off together with the eleventh transistor (M11).

The gate electrode of the fourteenth transistor (M14) may be connected to the output terminal of the input unit 202, and the first electrode of the fourteenth transistor (M14) may be connected to the gate electrode of the twelfth transistor (M12). The second electrode of the fourteenth transistor (M14) may be connected to the fourth power supply (VSS). The fourteenth transistor (M14) may control a voltage supplied to the gate electrode of the twelfth transistor (M12) while being turned on or turned off in accordance to the voltage supplied from the output terminal of the input unit 202.

The gate electrode of the fifteenth transistor (M15) may be connected to the first input terminal (clk), and the first electrode of the fifteenth transistor (M15) may be connected to the third input terminal (in). The second electrode of the fifteenth transistor (M15) may be connected to the gate electrode of the eleventh transistor (M11). The fifteenth transistor (M15) may supply a voltage of the third input terminal (in) to the gate electrode of the eleventh transistor (M11) while being turned on or turned off in accordance with the first clock signal (CLK1) or the second clock signal (CLK2) input through the first input terminal (clk).

The fourteenth capacitor (C14) may be connected between the output terminal (out) and the fourth power supply (VSS). The fourteenth capacitor (C14) may be employed for stabilizing the voltage of the output terminal (out).

The input unit 202 may supply a high level or a low level voltage to the output unit 204 that corresponds to a voltage of the first input terminal (clk), a second input terminal (/clk) and the third input terminal (in).

The input unit 202 may include an eighteenth transistor (M18) connected to the third power supply (VDD) and the third input terminal (in), a sixteenth transistor (M16) connected between the eighteenth transistor (M18) and the output unit 204, and a seventeenth transistor (M17) connected between the eighteenth transistor (M18) and the second input terminal (/clk).

The first electrode of the sixteenth transistor (M16) may be connected to an input terminal of the output unit 204, and the second electrode of the sixteenth transistor (M16) may be connected to the first input terminal (clk). The gate electrode of the sixteenth transistor (M16) may be connected to a second electrode of the eighteenth transistor (M18) and a first electrode of the seventeenth transistor (M17). The sixteenth transistor (M16) may be turned on or turned off in accordance with the voltage supplied from the third input terminal (in), the second input terminal (/clk), or the thirteenth capacitor (C13).

The thirteenth capacitor (C13) may be connected between the first electrode and the gate electrode of the sixteenth transistor (M16). A voltage corresponding to a turned-on or turned-off state of the sixteenth transistor (M16) may be charged in such a thirteenth capacitor (C13). For example, if the sixteenth transistor (M16) is turned on, then a voltage capable of turning on the sixteenth transistor (M16) may be charged in the thirteenth capacitor (C13), and if the sixteenth transistor (M16) is turned off, then a voltage capable of turning off the sixteenth transistor (M16) may be charged in the thirteenth capacitor (C13)

The gate electrode and the second electrode of the seventeenth transistor (M17) may be connected to the second input terminal (/clk), and the first electrode of the seventeenth transistor (M17) may be connected to a second electrode of the eighteenth transistor (M8). The seventeenth transistor (M17) may be connected in a diode form, and then turned on or turned off in accordance with the first clock signal (CLK1) or the second clock signal (CLK2) supplied to the second input terminal (/clk).

The gate electrode of the eighteenth transistor (M18) may be connected to the third input terminal (in), and the first electrode of the eighteenth transistor (M18) may be connected to the third power supply (VDD). The second electrode of the eighteenth transistor (M18) may be connected to the gate electrode of the sixteenth transistor (M16). The eighteenth transistor (M18) may be turned on or turned off in accordance with the voltage supplied to the third input terminal (in).

Figure 14:
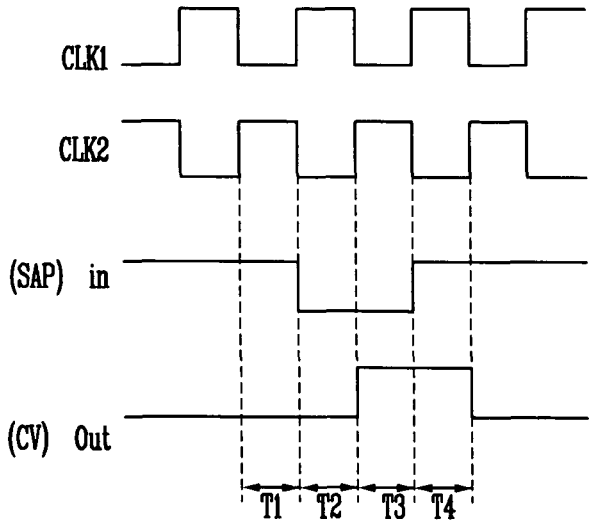
FIG. 14 illustrates a timing diagram for driving a conversion circuit of FIG. 13.

FIG. 14 illustrates a timing diagram for driving a conversion circuit of FIG. 13. In the following description, it will be assumed that the first clock signal (CLK1) may be supplied to the first input terminal (clk), and the second clock signal (CLK2) may be supplied to the second input terminal (/clk), as illustrated in FIG. 14. Referring to FIGS. 13 and 14, during the first period T(1), a low level voltage may be input through the first input terminal (clk), a high level voltage may be input through the second input terminal (/clk), and a high level voltage may be input through the third input terminal (in).

If the high level voltage is input through the third input terminal (in) and the second input terminal (/clk), then the seventeenth transistor (M17) and the eighteenth transistor (M18) may be turned off. At this time, the sixteenth transistor (M16) may be turned on by the voltage previously stored in the thirteenth transistor (C13). The low level voltage input through the first input terminal (clk) may be output through the output terminal of the input unit 202 via the sixteenth transistor (M16).

If the low level voltage is output through the output terminal of the input unit 202, then the fourteenth transistor (M14) may be turned on. Also, the fifteenth transistor (M15) may be turned on in accordance with the low level voltage supplied to the first input terminal (clk). If the fifteenth transistor (M15) is turned on, then the high level voltage supplied to the third input terminal (in) may be supplied to the gate electrodes of the eleventh transistor (M11) and the thirteenth transistor (M13). In this case, the eleventh transistor (M11) and the thirteenth transistor (M13) may be turned off, and a voltage corresponding to a turned-off state may be charged in the twelfth capacitor (C12).

If the fourteenth transistor (M14) is turned on, then the voltage of the fourth power supply (VSS) may be supplied to the gate electrode of the twelfth transistor (M12). If the voltage of the fourth power supply (VSS) is supplied to the gate electrode of the twelfth transistor (M12), then the twelfth transistor (M12) may be turned on, and a voltage corresponding to a turned-on state may be charged in the eleventh capacitor (C11). Furthermore, if the twelfth transistor (M12) is turned on, then a low level voltage may be output through the output terminal (out) during the first period (T1).

During the second period (T2), a high level voltage may be input to the first input terminal (clk), a low level voltage may be input to the second input terminal (/clk), and a low level voltage may be input to the third input terminal (in).

If the low level voltage is input to the second input terminal (/clk), then a seventeenth transistor (M17) may be turned on. If the low level voltage is input to the third input terminal (in), then the eighteenth transistor (M18) may be turned on. In this case, the sixteenth transistor (M16) may be turned on, and the high level voltage input to the first input terminal (clk) may be output through the output terminal of the input unit 202. At this time, a voltage corresponding to a turned-on state of the sixteenth transistor (M16) may be charged in the thirteenth capacitor (C13).

If a high level voltage is output through the output terminal of the input unit 202, then a fourteenth transistor (M14) may be turned off. The fifteenth transistor (M15) may be turned off in accordance with the high level voltage supplied to the first input terminal (clk).

If the fifteenth transistor (M15) is turned off, then the eleventh transistor (M11) and the thirteenth transistor (M13) may be turned off in accordance with the turned-off voltage stored in the twelfth capacitor (C12). Furthermore, if the fourteenth transistor (M14) is turned off, then the twelfth transistor (M12) may be turned on in accordance with the turned-on voltage stored in the eleventh capacitor (C11), and a low level voltage may be output through the output terminal (out). That is, the previous output state of the first period (T1) may be maintained during the second period (T2).

During the third period (T3), a low level voltage may be input to the first input terminal (clk), a high level voltage may be input to the second input terminal (/clk), and a low level voltage may be input to the third input terminal (in).

If a high level of a voltage is input to the second input terminal (/clk), then the seventeenth transistor (M17) may be turned off. If a low level voltage is input to the third input terminal (in), then the eighteenth transistor (M18) may be turned on. The gate voltage of the sixteenth transistor (M16) may be increased to a voltage of the third power supply (VDD). If the gate voltage of the sixteenth transistor (M16) is increased to the voltage of the third power supply (VDD), then a voltage of a first electrode of the sixteenth transistor (M16) may not be reduced below the voltage of the third power supply (VDD), and therefore the fourteenth transistor (M14) may be turned off.

The fifteenth transistor (M15) may be turned on in accordance with the low level voltage supplied to the first input terminal (clk). If the fifteenth transistor (M15) is turned on, then the low level voltage input to the third input terminal (in) may be supplied to the gates of the eleventh transistor (M11) and the thirteenth transistor (M13). Accordingly, the eleventh transistor (M11) and the thirteenth transistor (M13) may be turned on. In this case, a voltage corresponding to a turned-on state of the eleventh transistor (M11) may be charged in the twelfth capacitor (C12).

If the eleventh transistor (M11) is turned on, then a voltage of the third a power supply (VDD) may be supplied to the output terminal (out). That is, a high level voltage may be output to the output terminal (out). If the thirteenth transistor (M13) is turned on, then the third power supply (VDD) may be supplied to the gate electrode of the twelfth transistor (M12), and therefore the twelfth transistor (M12) may be turned off. In this case, a voltage corresponding to a turned-off state may be stored in the eleventh capacitor (C11).

During the fourth period (T4), a high level voltage may be input to the first input terminal (clk), a low level voltage may be input to the second input terminal (/clk), and a high level voltage may be input to the third input terminal (in).

If the low level voltage is input to the second input terminal (/clk), then a seventeenth transistor (M17) may be turned on. If the high level voltage is input to the third input terminal (in), then the eighteenth transistor (M18) may be turned off. The low level voltage input to the second input terminal (/clk) may be supplied to the sixteenth transistor (M16), and therefore the sixteenth transistor (M16) may be turned on. If the sixteenth transistor (M16) is turned on, then the high level voltage supplied to the first input terminal (clk) may be supplied to the fourteenth transistor (M14), and therefore the fourteenth transistor (M14) may be turned off.

The fifteenth transistor (M15) may be turned off in accordance with the high level voltage supplied to the first input terminal (clk). If the fifteenth transistor (M15) is turned off, then the eleventh transistor (M11) and the thirteenth transistor (M13) may be turned on by the voltage stored in the twelfth capacitor (C12). If the fourteenth transistor (M14) is turned off, then the twelfth transistor (M12) is turned off in accordance with the voltage stored in the eleventh capacitor (C11). That is, the same high level voltage output during the third period (T3) may be output during the fourth period (T4).

As discussed above, the conversion circuit (CC) may output a voltage level opposite to a voltage supplied to the third input terminal (in) if a low level voltage is input to the first input terminal (clk), and may maintain its output of the previous period if a high level voltage is input to the first input terminal (clk).

As described above, a data driver and an organic light emitting display using the same according to embodiments of the present invention may enable the data driver to be mounted in a panel. In particular, the shift registers, the sampling latches, the holding latches and the DAC included in the data driver may be implemented with only PMOS transistors. Accordingly, the data driver may be mounted in the panel and may be manufactured at a reduced cost.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A data driver, comprising:

a shift register unit configured to receive a first clock signal, a second clock signal, and a start pulse, and to generate a sampling pulse;

a sampling latch unit configured to receive and output bits and inverted bits of digital data, in correspondence with the sampling pulse;

a holding latch unit configured to receive the bits and inverted bits output by the sampling latch unit, and to output the bits and inverted bits, in correspondence with a first enable signal and a second enable signal; and a digital-to-analog converter configured to receive the bits and inverted bits output by the holding latch unit and to generate an analog signal corresponding to values of the received bits and inverted bits, wherein:

the shift register unit includes at least one shift register, the sampling latch unit includes at least one sampling latch, and the holding latch unit includes at least one holding latch, the shift register includes:

a first shift register transistor having a gate electrode connected to a second shift register input terminal, a second electrode connected to a first node, and a first electrode connected to an external shift register input terminal;

a second shift register transistor having a gate electrode connected to the first node, a first electrode connected to a first shift register input terminal, and a second electrode connected to a shift register output terminal;

a third shift register transistor having a gate electrode connected to the second shift register input terminal, a first electrode connected to a second shift register node, and a second electrode connected to a fourth shift register power supply;

a fourth shift register transistor having a gate electrode connected to the first shift register node, a first electrode connected to the second shift register input terminal, and a second electrode connected to the second shift register node;

a fifth shift register transistor having a gate electrode connected to the second shift register node, a first electrode connected to a third shift register power supply, and a second electrode connected to the shift register output terminal; and a shift register capacitor connected between the gate electrode and the second electrode of the second transistor, the sampling latch includes:

a first sampling latch transistor having a gate electrode connected to a second sampling latch input terminal, a second electrode connected to a first node, and a first electrode connected to an external sampling latch input terminal;

a second sampling latch transistor having a gate electrode connected to the first node, a first electrode connected to a first sampling latch input terminal, and a second electrode connected to a sampling latch output terminal;

a third sampling latch transistor having a gate electrode connected to the second sampling latch input terminal, a first electrode connected to a second sampling latch node, and a second electrode connected to a fourth sampling latch power supply;

a fourth sampling latch transistor having a gate electrode connected to the first sampling latch node, a first electrode connected to the second sampling latch input terminal, and a second electrode connected to the second sampling latch node;

a fifth sampling latch transistor having a gate electrode connected to the second sampling latch node, a first electrode connected to a third sampling latch power supply, and a second electrode connected to the sampling latch output terminal; and a sampling latch capacitor connected between the gate electrode and the second electrode of the second transistor; and the holding latch includes:

a first holding latch transistor having a gate electrode connected to a second holding latch input terminal, a second electrode connected to a first node, and a first electrode connected to an external holding latch input terminal;

a second holding latch transistor having a gate electrode connected to the first node, a first electrode connected to a first holding latch input terminal, and a second electrode connected to a holding latch output terminal;

a third holding latch transistor having a gate electrode connected to the second holding latch input terminal, a first electrode connected to a second holding latch node, and a second electrode connected to a fourth holding latch power supply;

a fourth holding latch transistor having a gate electrode connected to the first holding latch node, a first electrode connected to the second holding latch input terminal, and a second electrode connected to the second holding latch node;

a fifth holding latch transistor having a gate electrode connected to the second holding latch node, a first electrode connected to a third holding latch power supply, and a second electrode connected to the holding latch output terminal; and a holding latch capacitor connected between the gate electrode and the second electrode of the second transistor.

2. The data driver as claimed in claim 1, wherein the first through fifth transistors are PMOS transistors.

3. The data driver as claimed in claim 1, wherein the third power supply provides a higher voltage than that provided by the fourth power supply.

4. The data driver as claimed in claim 1, wherein the shift register unit includes even and odd-numbered shift registers, the first clock signal is supplied to the first input terminals of the odd-numbered shift registers, and the second clock signal is supplied to the second input terminals of the odd-numbered shift registers.

5. The data driver as claimed in claim 4, wherein the second clock signal is supplied to the first input terminals of the even-numbered shift registers, and the first clock signal is supplied to the second input terminals of the even-numbered shift registers.

6. The data driver as claimed in claim 1, wherein, in the shift register:

when a low level signal is supplied to the second input terminal, the capacitor is charged with a voltage that corresponds to the voltage supplied from the external input terminal, and when a high level signal is supplied to the second input terminal, a voltage is supplied to the output terminal that corresponds to the voltage charged in the capacitor.

7. The data driver as claimed in claim 1, wherein, in the sampling latch:

the sampling pulse is supplied to the second input terminal, and a charging signal is supplied to the first input terminal.

8. The data driver as claimed in claim 7, wherein the sampling latch receives each bit or inverted bit when the sampling pulse is at a low level and the charging signal is at a high level, and the sampling latch outputs each bit or inverted bit when the sampling pulse is at a high level and the charging signal is at a low level.

9. The data driver as claimed in claim 1, wherein, in the holding latch:

the first enable signal is provided to the second input terminal, and the second enable signal is provided to the first input terminal.

10. The data driver as claimed in claim 9, wherein the first enable signal and the second enable signal have a phase difference of about 180 degrees.

11. The data driver as claimed in claim 9, wherein the holding latch receives a signal from the sampling latch when the first enable signal is at a low level, and the received signal is output by the holding latch when the first enable signal is at a high level.

12. The data driver as claimed in claim 9, wherein the first enable signal is maintained at a high level during output by the sampling latch, and the first enable signal changes to a low level after output by the sampling latch.

13. An organic light emitting display, comprising:

a scan driver configured to sequentially supply a scan signal to scan lines;

the data driver as claimed in claim 1, the data driver being configured to supply a data signal to data lines; and a pixel unit including a plurality of pixels connected to the scan lines and the data lines.

14. A data driver, comprising:

a shift register unit configured to receive a first clock signal, a second clock signal, and a start pulse, and to generate a sampling pulse;

a sampling latch unit configured to receive and output bits and inverted bits of digital data, in correspondence with the sampling pulse;

a holding latch unit configured to receive the bits and inverted bits output by the sampling latch unit, and to output the bits and inverted bits, in correspondence with a first enable signal and a second enable signal;

a digital-to-analog converter configured to receive the bits and inverted bits output by the holding latch unit and to generate an analog signal corresponding to values of the received bits and inverted bits; and a conversion unit configured to receive the first clock signal, the second clock signal and the sampling pulse, and to sequentially generate a conversion signal that is supplied to the sampling latch unit, the conversion unit including an input unit and an output unit, the output unit being configured to control whether or not the conversion signal is output, wherein the output unit includes:

an eleventh transistor having a first electrode connected to a third power supply and having a second electrode connected to an output terminal;

a twelfth transistor having a first electrode connected to the output terminal and having a second electrode connected to a fourth power supply, the fourth power supply providing a lower voltage than that provided by the third power supply;

a thirteenth transistor having a gate electrode connected to a gate electrode of the eleventh transistor and having a first electrode connected to the second electrode of the eleventh transistor;

a fourteenth transistor having a first electrode connected to a second electrode of the thirteenth transistor, having a second electrode connected to the fourth power supply, and having a gate electrode connected to the input unit;

a fifteenth transistor having a first electrode connected to a third input terminal, having a second electrode connected to the gate electrode of the eleventh transistor, and having a gate electrode connected to a first input terminal;

a twelfth capacitor connected between the gate electrode and the first electrode of the eleventh transistor; and an eleventh capacitor connected between a gate electrode of the twelfth transistor and the first electrode of the twelfth transistor.

15. The data driver as claimed in claim 14, further comprising a fourteenth capacitor connected between the output terminal and the fourth power supply.

16. The data driver as claimed in claim 14, wherein the input unit includes:

a sixteenth transistor having a first electrode connected to the gate electrode of the fourteenth transistor and having a second electrode connected to the first input terminal;

a seventeenth transistor having a first electrode connected to a gate electrode of the sixteenth transistor, and having a gate electrode and a second electrode both connected to a second input terminal;

an eighteenth transistor having a gate electrode connected to the third input terminal, having a first electrode connected to the third power supply, and having a second electrode connected to the gate electrode of the sixteenth transistor; and a thirteenth capacitor connected between the gate electrode of the sixteenth transistor and the first electrode of the sixteenth transistor.

17. The data driver as claimed in claim 16, wherein the eleventh through eighteenth transistors are PMOS transistors.

18. The data driver as claimed in claim 16, wherein the conversion unit includes even numbered and odd-numbered conversion circuits, and the odd-numbered conversion circuits receive the first clock signal at the first input terminal, and receive the second clock signal at the second input terminal.

19. The data driver as claimed in claim 18, wherein the even-numbered conversion circuits receive the second clock signal at the first input terminal, and receive the first clock signal at the second input terminal.

20. The data driver as claimed in claim 16, wherein the conversion circuit outputs a signal level opposite to a signal input to the third input terminal if a low level signal is input to the first input terminal, and the conversion circuit maintains an output of a previous period if a high level signal is input to the first input terminal.

21. An organic light emitting display, comprising:

a scan driver configured to sequentially supply a scan signal to scan lines;

the data driver as claimed in claim 14, the data driver being configured to supply a data signal to data lines; and a pixel unit including a plurality of pixels connected to the scan lines and the data lines.

* * * * *